US011741934B1

(12) United States Patent
Zhang et al.

(10) Patent No.: US 11,741,934 B1
(45) Date of Patent: Aug. 29, 2023

(54) REFERENCE FREE ACOUSTIC ECHO CANCELLATION

(71) Applicant: Amazon Technologies, Inc., Seattle, WA (US)

(72) Inventors: Tao Zhang, Eden Prairie, MN (US); Yiteng Huang, Basking Ridge, NJ (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/708,522

(22) Filed: Mar. 30, 2022

Related U.S. Application Data

(60) Provisional application No. 63/283,749, filed on Nov. 29, 2021.

(51) Int. Cl.
*G10K 11/178* (2006.01)

(52) U.S. Cl.
CPC .. *G10K 11/17827* (2018.01); *G10K 11/17837* (2018.01); *G10K 11/17853* (2018.01); *G10K 11/17881* (2018.01)

(58) Field of Classification Search
None
See application file for complete search history.

(56) References Cited

U.S. PATENT DOCUMENTS

| | | | |
|---|---|---|---|
| 9,521,486 | B1 | 12/2016 | Barton |
| 9,966,059 | B1 | 5/2018 | Ayrapetian et al. |
| 9,973,849 | B1 | 5/2018 | Zhang et al. |
| 10,237,647 | B1 | 3/2019 | Chhetri |
| 10,522,167 | B1 | 12/2019 | Ayrapetian et al. |
| 10,553,236 | B1 | 2/2020 | Ayrapetian et al. |
| 10,657,981 | B1 | 5/2020 | Mansour et al. |
| 10,755,728 | B1 | 8/2020 | Ayrapetian et al. |
| 10,777,214 | B1 | 9/2020 | Shi et al. |
| 2014/0067386 | A1 | 3/2014 | Zhang et al. |
| 2015/0179160 | A1 | 6/2015 | Wu et al. |
| 2018/0249246 | A1 | 8/2018 | Kjems et al. |
| 2022/0335923 | A1* | 10/2022 | Yuan ..... G10K 11/17854 |

FOREIGN PATENT DOCUMENTS

| | | | |
|---|---|---|---|
| KR | 101312451 | B1 | 9/2013 |
| WO | 2009034524 | A1 | 3/2009 |

OTHER PUBLICATIONS

U.S. Appl. No. 17/218,257, filed Mar. 31, 2021.
Notice of Allowance and Fee(s) Due dated Mar. 28, 2022 for U.S. Appl. No. 17/218,257.

* cited by examiner

*Primary Examiner* — Kenny H Truong
(74) *Attorney, Agent, or Firm* — Pierce Atwood LLP

(57) ABSTRACT

A multi-microphone device that can perform acoustic echo cancellation (AEC) without an external reference signal. The device uses the audio data from one of its microphones as a reference for purposes of AEC and acoustic noise cancellation (ANC). The device determines filter coefficients for an adaptive filter for ANC when cancelling one microphone signal from another microphone's signal. Those filter coefficients are buffered and delayed and then used for AEC operations cancelling one microphone signal from another microphone's signal. When desired audio (such as a wakeword, speech, or the like) is detected, the device may freeze the coefficients for purposes of performing AEC until the desired audio is complete. The device may then continue adapting and using the coefficients.

20 Claims, 16 Drawing Sheets

REFERENCE FREE ACOUSTIC ECHO CANCELLATION

RELATED APPLICATIONS

This application claims the benefit of priority of U.S. Provisional Patent Application 63/283,749, filed Nov. 29, 2021, and entitled "Reference Free Acoustic Echo Cancellation," the contents of which are expressly incorporated herein by reference in its entirety.

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Figure 1:
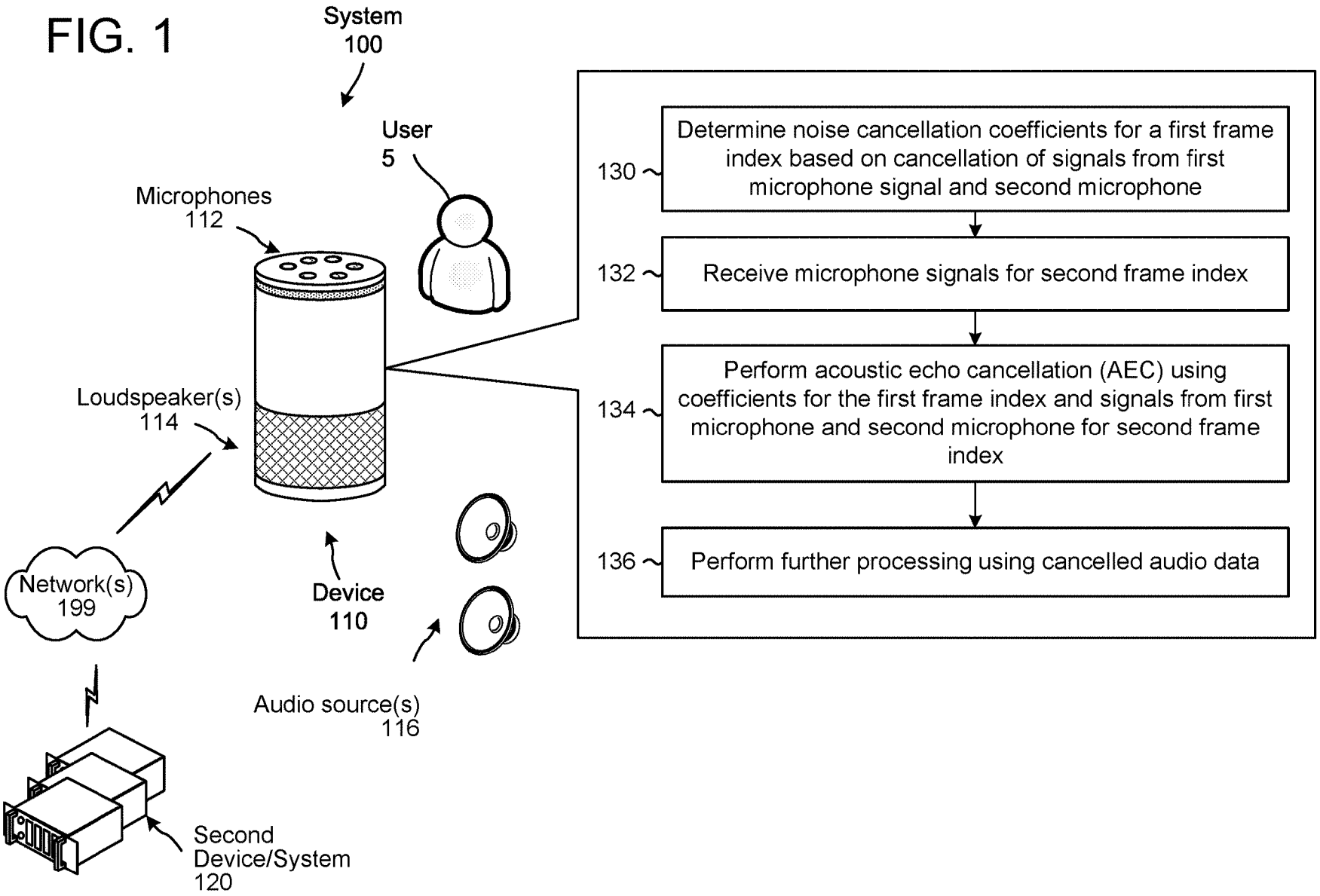
FIG. 1 is a conceptual diagram illustrating a system configured to perform microphone-based acoustic echo cancellation according to embodiments of the present disclosure.

Electronic devices may be used to capture and process audio data. The audio data may be used for voice commands and/or may be output by loudspeakers as part of a communication session. In some examples, loudspeakers may generate audio using playback audio data while a microphone generates local audio data. An electronic device may perform audio processing, such as acoustic echo cancellation (AEC), to remove an "echo" signal corresponding to the playback audio data from the local audio data, isolating local speech to be used for voice commands and/or the communication session. The echo may be impacted by an echo path, which indicates the acoustic conditions of the environment of the device and may be estimated and accounted for when performing echo and/or other noise cancellation.

In some examples, the device may perform echo cancellation processing to remove one or more reference signals from one or more microphone signals. Thus, if a device has an available representation of audio to be cancelled (for example, music playing the background), that external reference data (meaning reference data received from a source other than the device itself) may be used to perform echo cancellation, thus removing the background audio to isolate other desired audio, such as speech of a spoken command, or the like. However, as the number of external reference signals and/or the number of microphone signals increases, a complexity of performing echo cancellation also increases. Further, in some situations an external reference signal may not match the actual echo experienced by an audio capture device, for example where nonlinearities/distortions are caused by one or more audio sources (e.g., poor quality loudspeakers or low output audio) and/or exist in an echo path (for example, a room with high reverberation), or the like. Further, in certain situations an audio capture device may not have an available external reference signal with which to perform echo cancellation, for example when an external loudspeaker is playing music that is unknown to a system of a device. In such situations, echo cancellation that relies on a reference signal may not be possible.

Offered is an improvement to external reference signal-based AEC. For example, the techniques offered herein may be used by a device that includes multiple microphones. A device may cancel audio data from one microphone(s) from another microphone. The signal from one microphone (for example, a second microphone) can thus be used to perform acoustic echo cancellation, reducing a reliance on an external reference signal. Further, because the signal of the second microphone includes a representation of other undesired audio (e.g., noise as well as echo) that may appear in the environment, the present techniques have the benefit of also acting to perform noise cancellation in addition to echo cancellation. Further, because an output microphone signal can be used in lieu of a speaker-based/external reference signal, assumptions that may otherwise have been required with regard to some types of reference signals may be avoided.

The present techniques allow for AEC to be performed in an environment where there may be background/undesired audio, e.g., background music or the like. that would otherwise interfere with capture of desired audio, such as speech including a command to a speech-controlled device, detecting particular sounds in an environment (e.g., coughing, footsteps, crying, barking, device sounds like a smoke alarm, etc. such as those discussed below with regard to acoustic event detection (AED) component 1040), detecting audio watermarks, identifying content based its audio, or the like.

The present technique can use an adaptive filter to determine noise/echo cancellation coefficients based on the signal from one microphone (e.g., a second microphone) of a device. Such coefficients represent the echo path of the environment of the device. Such coefficients may be buffered/delayed for a period of time and then applied to later received audio. Thus undesired audio present in the later audio may be cancelled based on the input audio of the second microphone. As such AEC is performed, the resulting cancelled audio may be processed by a downstream component such as a voice activity detector (VAD), wakeword (WW) detector, AED 1040, watermark detector, or the like. If a wakeword/desired speech is detected the system may freeze adaptation of the filter coefficients and may continue to use the same filter coefficients that were used to determine the audio data that included the representation of the wakeword. After some period of time expires, for example after the desired speech has been captured by the device, the device may resume adaptation of the filter coefficients for AEC purposes as described herein.

FIG. 1 illustrates a system configured to perform such microphone-based acoustic echo cancellation (MB-AEC) according to embodiments of the present disclosure. For example, the system 100 may be configured to receive or generate microphone audio signals and perform echo cancellation to generate an output audio signal representing desired speech. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a device 110 that may be communicatively coupled to network(s) 199. The device 110 may include or be a part of a natural language command processing system, such as the system 100 shown in FIG. 10. The device 110 may include microphones 112 in a microphone array and/or two or more loudspeakers 114. However, the disclosure is not limited thereto and the device 110 may include additional components without departing from the disclosure. While FIG. 1 illustrates the loudspeakers 114 being internal to the device 110, the disclosure is not limited thereto and the loudspeakers 114 may be external to the device 110 without departing from the disclosure. For example, the loudspeakers 114 may be separate from the device 110 and connected to the device 110 via a wired connection and/or a wireless connection without departing from the disclosure. The device 110 may also be in an environment where other audio sources 116 are located. The device 110 may not have access to an external reference signal corresponding to the audio (e.g., music, etc.) being output by the audio sources 116, and so thus may use MB-AEC techniques such as those disclosed herein to cancel any echo caused by audio from audio sources 116 as well as to cancel any noise in the environment of the device 110. Alternatively, or in addition, the device 110 may be outputting audio using loudspeaker 114 and may not have access to an external reference signal corresponding to that audio. MB-AEC may be used in such a situation as well.

The device 110 may be an electronic device configured to send audio data to and/or receive audio data. In some examples, the user 5 may be listening to music or a program that is playing in the environment of the device through loudspeaker(s) 114, audio source(s) 116, and/or otherwise. While the audio is playing in the environment the device 110 may capture microphone audio data $x_m(t)$ (e.g., input audio data) using the microphones 112. In addition to capturing desired speech (e.g., the microphone audio data includes a representation of local speech from a user 5), the device 110 may capture a portion of the output audio generated by the loudspeakers 114/116 (including a portion of the music, remote speech, or other audio), which may be referred to as an "echo" or echo signal, along with additional acoustic noise (e.g., undesired speech, ambient acoustic noise in an environment around the device 110, etc.).

In some examples, the microphone audio data $x_m(t)$ may include a voice command directed to a remote system, which may be indicated by a keyword (e.g., wakeword). For example, the device 110 detect that the wakeword is represented in the microphone audio data $x_m(t)$ and may send the microphone audio data $x_m(t)$ to component for speech processing. Speech processing may be permed by the device 110 and/or by a remote system such as system 120. Thus, a device/system may determine a voice command represented in the microphone audio data $x_m(t)$ and may perform an action corresponding to the voice command (e.g., execute a command, send an instruction to the device 110 and/or other devices to execute the command, etc.). In some examples, to determine the voice command the remote system may perform Automatic Speech Recognition (ASR) processing, Natural Language Understanding (NLU) processing and/or command processing as discussed herein. The voice commands may control the device 110, audio devices (e.g., play music over loudspeakers 114, capture audio using microphones 112, or the like), multimedia devices (e.g., play videos using a display, such as a television, computer, tablet or the like), smart home devices (e.g., change temperature controls, turn on/off lights, lock/unlock doors, etc.) or the like.

Additionally or alternatively, in some examples the device 110 may send the microphone audio data $x_m(t)$ to the remote device as part of a Voice over Internet Protocol (VoIP) communication session or the like. For example, the device 110 may send the microphone audio data $x_m(t)$ to the remote device either directly or via remote system 120 and may receive playback audio data the remote device either directly or via the remote system. During the communication session, the device 110 may also detect the keyword (e.g., wakeword) represented in the microphone audio data $x_m(t)$ and/or send a portion of the microphone audio data $x_m(t)$ to the remote system in order for the remote system to determine a voice command.

Prior to sending the microphone audio data $x_m(t)$ for further processing, such as speech processing or the like, the device 110 may perform audio processing to isolate local speech captured by the microphones 112 and/or to suppress unwanted audio data (e.g., echoes and/or noise). For example, the device 110 may perform acoustic echo cancellation (AEC) to isolate speech or other desired input audio. Additionally or alternatively, the device 110 may perform beamforming (e.g., operate microphones 112 using beamforming techniques), adaptive interference cancellation (AIC), residual echo suppression (RES), and/or other audio processing without departing from the disclosure.

The device, as noted, may not have external reference data corresponding to echo detected in the environment. In such a situation, for example, the device may perform microphone-based acoustic echo cancellation as disclosed herein. The device may receive a first plurality of audio signals from the microphone array, where the first plurality includes a first signal for a first microphone, a second signal for a second microphone, etc. The first plurality may all correspond to a first frame index, first time period, etc. such that the first plurality of audio signals represents the individual microphone's detected representations of the audio in the environment of the device. Those representations may include speech, noise, echo, etc. depending on the audio in the environment.

The device 110 may use the signal of one microphone to cancel the signal of another microphone using noise cancellation techniques. In doing so, the device 110 may determine (130) noise cancellation coefficients for the first frame index. The device 110 may then store those coefficients for use after some delay time period, discussed further below. The device 110 may then receive (132) microphone signals for a second frame index after the first frame index. These microphone signals may include signals for the first microphone, second microphone, etc. The second frame index may correspond to the delay time period after the first frame index and so the device 110 may perform (134) acoustic echo cancellation (AEC) by applying the stored coefficients (from the first frame index) to the signal from the second microphone to determine modified audio data. This may include multiplying the coefficients by audio data in the frequency domain, convolving the coefficients with the audio data in the time domain, or the like. The device 110 may then subtract that modified audio data from an audio signal (corresponding to the second frame index) from the first microphone to obtain cancelled audio data. As explained below, that cancelled audio data may represent the audio of the environment of the device 110, only with the noise and echo removed/cancelled as a result of cancelling one microphone's audio from another's. The device 110 may then perform (136) further processing (such as wakeword detection, speech processing, acoustic event detection, watermark detection, etc.) using the cancelled audio data.

As used herein, an audio signal may include a representation of sound and an electronic representation of an audio signal may be referred to as audio data, which may be analog and/or digital without departing from the disclosure. For ease of illustration, the disclosure may refer to either audio data (e.g., far-end reference audio data or playback audio data, microphone audio data, near-end reference data or input audio data, etc.) or audio signals (e.g., playback signal, far-end reference signal, microphone signal, near-end reference signal, etc.) interchangeably without departing from the disclosure. For example, some audio data may be referred to as playback audio data, microphone audio data $x_m(t)$, error audio data, output audio data, and/or the like. Additionally or alternatively, this audio data may be referred to as audio signals such as a playback signal, microphone signal $x_m(t)$, error signal, output audio data, and/or the like without departing from the disclosure.

Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, audio data may be captured by the microphones 112 in the time-domain. However, the device 110 may convert the audio data to the frequency-domain or subband-domain in order to perform beamforming, aligned beam merger (ABM) processing, acoustic echo cancellation (AEC) processing, and/or additional audio processing without departing from the disclosure.

As used herein, audio signals or audio data (e.g., far-end reference audio data, near-end reference audio data, microphone audio data, or the like) may correspond to a specific range of frequency bands. For example, far-end reference audio data and/or near-end reference audio data may correspond to a human hearing range (e.g., 20 Hz-20 kHz), although the disclosure is not limited thereto.

As used herein, a frequency band/frequency bin corresponds to a frequency range having a starting frequency and an ending frequency. Thus, the total frequency range may be divided into a fixed number (e.g., 256, 512, etc.) of frequency ranges, with each frequency range referred to as a frequency band and corresponding to a uniform size. However, the disclosure is not limited thereto and the size of the frequency band may vary without departing from the disclosure.

Playback audio data (e.g., far-end reference signal) corresponds to audio data that will be output by the loudspeakers 114 (and/or audio source(s) 116) to generate playback audio (e.g., echo signal). For example, the device 110 may stream music or output speech associated with a communication session (e.g., audio or video telecommunication). In some examples, the playback audio data may be referred to as far-end reference audio data, loudspeaker audio data, and/or the like without departing from the disclosure.

Microphone audio data $x_m(t)$ corresponds to audio data that is captured by one or more microphones 112 prior to the device 110 performing audio processing such as AEC processing or beamforming. The microphone audio data $x_m(t)$ may include local speech s(t) (e.g., an utterance, such as near-end speech generated by the user 5), an "echo" signal y(t) (e.g., portion of the playback audio captured by the microphones 112), acoustic noise (e.g., ambient noise in an environment around the device 110), and/or the like. As the microphone audio data is captured by the microphones 112 and captures audio input to the device 110, the microphone audio data may be referred to as input audio data, near-end audio data, and/or the like without departing from the disclosure. For ease of illustration, the following description will refer to this signal as microphone audio data. As noted above, the microphone audio data may be referred to as a microphone signal without departing from the disclosure.

An "echo" signal corresponds to a portion of playback audio that reaches the microphones 112 (e.g., portion of audible sound(s) output by the loudspeakers 114 or audio source(s) 116 that is recaptured by the microphones 112) and may be referred to as an echo or echo data.

Figure 2A:
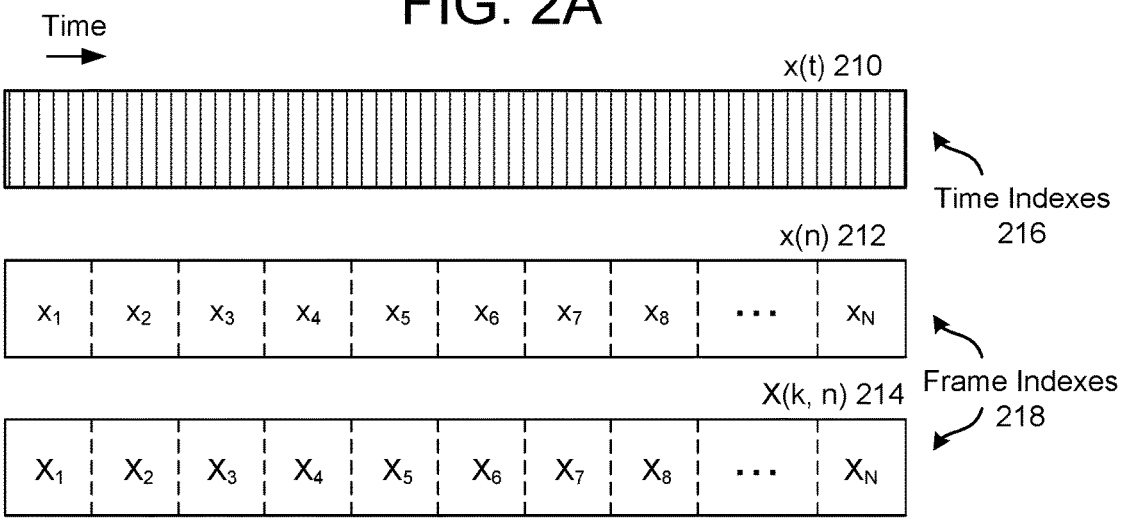
FIGS. 2A-2D illustrate examples of frame indexes, tone indexes, and channel indexes.
Figure 2B:
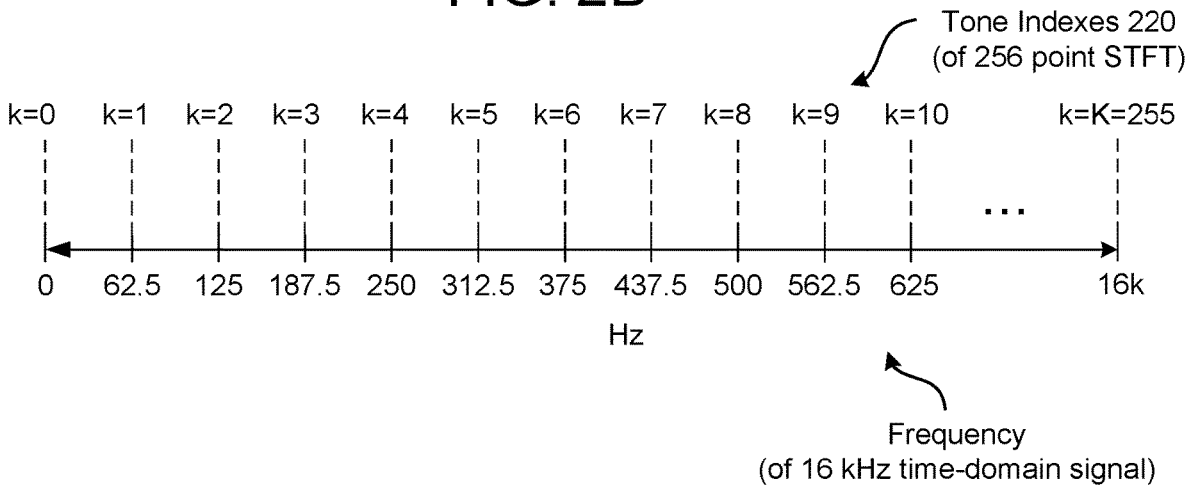
Figure 2C:
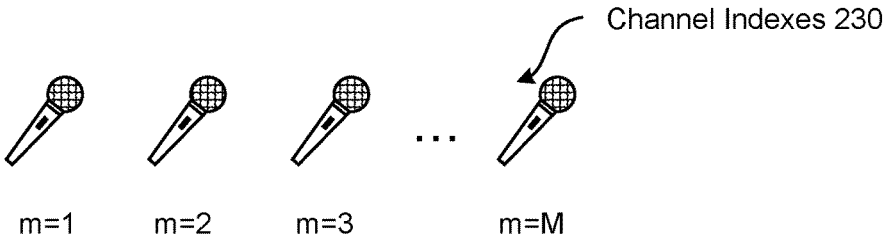

FIGS. 2A-2C illustrate examples of frame indexes, tone indexes, and channel indexes. As described above, the device 110 may generate microphone audio data $x_m(t)$ using microphones 112. For example, a first microphone 112A may generate first microphone audio data $x_1(t)$ in a time domain, a second microphone 112B may generate second microphone audio data $x_2(t)$ in the time domain, and so on. As illustrated in FIG. 2A, a time domain signal may be represented as microphone audio data x(t) 210, which is comprised of a sequence of individual samples of audio data. Thus, x(t) denotes an individual sample that is associated with a time t.

While the microphone audio data x(t) 210 is comprised of a plurality of samples, in some examples the device 110 may group a plurality of samples and process them together. As illustrated in FIG. 2A, the device 110 may group a number of samples together in a frame to generate microphone audio data x(n) 212. As used herein, a variable x(n) corresponds to the time-domain signal and identifies an individual frame (e.g., fixed number of samples s) associated with a frame index n.

Additionally or alternatively, the device 110 may convert microphone audio data x(n) 212 from the time domain to the frequency domain or subband domain. For example, the device 110 may perform Discrete Fourier Transforms (DFTs) (e.g., Fast Fourier transforms (FFTs), short-time Fourier Transforms (STFTs), and/or the like) to generate microphone audio data X(k, n) 214 in the frequency domain or the subband domain. As used herein, a variable X(k, n) corresponds to the frequency-domain signal and identifies an individual frame associated with frame index n and tone index k (sometimes also referred to as a frequency bin, STFT bin, or the like). As illustrated in FIG. 2A, the microphone audio data x(t) 212 corresponds to time indexes 216, whereas the microphone audio data x(n) 212 and the microphone audio data X(k, n) 214 corresponds to frame indexes 218.

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data X(n). However, the disclosure is not limited thereto and the system 100 may instead perform short-time Fourier transform (STFT) operations without departing from the disclosure. A short-time Fourier transform is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., microphone audio data x(t) 210) and frame indexes 218 (e.g., microphone audio data x(n) 212 in the time domain and microphone audio data X(k, n) 216 in the frequency domain). For example, the system 100 may apply FFT processing to the time-domain microphone audio data x(n) 212, producing the frequency-domain microphone audio data X(n,k) 214, where the tone index "k" (e.g., frequency index) ranges from 0 to K and "n" is a frame index ranging from 0 to N. As illustrated in FIG. 2A, the history of the values across iterations is provided by the frame index "n", which ranges from 1 to N and represents a series of samples over time.

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 72B illustrates the frequency range being divided into 256 different subbands (e.g., tone indexes), the disclosure is not limited thereto and the system 100 may divide the frequency range into K different subbands (e.g., K indicates an FFT size). While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

The system 100 may include multiple microphones 112, with a first channel m corresponding to a first microphone 112A, a second channel (m+1) corresponding to a second microphone 112B, and so on until a final channel (MP) that corresponds to microphone 112M. FIG. 2C illustrates channel indexes 230 including a plurality of channels from channel ml to channel M. While many drawings illustrate two channels (e.g., two microphones 112), the disclosure is not limited thereto and the number of channels may vary. For the purposes of discussion, an example of system 100 includes "M" microphones 112 (M>1) for hands free near-end/far-end distant speech recognition applications.

While FIGS. 2A-2D are described with reference to the microphone audio data $x_m(t)$, the disclosure is not limited thereto and the same techniques apply to the playback audio data $x_r(t)$ without departing from the disclosure. Thus, playback audio data $x_r(t)$ indicates a specific time index t from a series of samples in the time-domain, playback audio data $x_r(n)$ indicates a specific frame index n from series of frames in the time-domain, and playback audio data $X_r(k, n)$ indicates a specific frame index n and frequency index k from a series of frames in the frequency-domain.

Prior to converting the microphone audio data $x_m(n)$ and the playback audio data $x_r(n)$ to the frequency-domain, the device 110 may first perform time-alignment to align the playback audio data $x_r(n)$ with the microphone audio data $x_m(n)$. For example, due to nonlinearities and variable delays associated with sending the playback audio data $x_r(n)$ to the loudspeakers 114 using a wireless connection, the playback audio data $x_r(n)$ is not synchronized with the microphone audio data $x_m(n)$. This lack of synchronization may be due to a propagation delay (e.g., fixed time delay) between the playback audio data $x_r(n)$ and the microphone audio data $x_m(n)$, clock jitter and/or clock skew (e.g., difference in sampling frequencies between the device 110 and the loudspeakers 114), dropped packets (e.g., missing samples), and/or other variable delays.

To perform the time alignment, the device 110 may adjust the playback audio data $x_r(n)$ to match the microphone audio data $x_m(n)$. For example, the device 110 may adjust an offset between the playback audio data $x_r(n)$ and the microphone audio data $x_m(n)$ (e.g., adjust for propagation delay), may add/subtract samples and/or frames from the playback audio data $x_r(n)$ (e.g., adjust for drift), and/or the like. In some examples, the device 110 may modify both the microphone audio data and the playback audio data in order to synchronize the microphone audio data and the playback audio data.

However, performing nonlinear modifications to the microphone audio data results in first microphone audio data associated with a first microphone to no longer be synchronized with second microphone audio data associated with a second microphone. Thus, the device 110 may instead modify only the playback audio data so that the playback audio data is synchronized with the first microphone audio data.

While FIG. 2A illustrates the frame indexes 218 as a series of distinct audio frames, the disclosure is not limited thereto. In some examples, the device 110 may process overlapping audio frames and/or perform calculations using overlapping time windows without departing from the disclosure. For example, a first audio frame may overlap a second audio frame by a certain amount (e.g., 80%), such that variations between subsequent audio frames are reduced. Additionally or alternatively, the first audio frame and the second audio frame may be distinct without overlapping, but the device 110 may determine power value calculations using overlapping audio frames. For example, a first power value calculation associated with the first audio frame may be calculated using a first portion of audio data (e.g., first audio frame and n previous audio frames) corresponding to a fixed time window, while a second power calculation associated with the second audio frame may be calculated using a second portion of the audio data (e.g., second audio frame, first audio frame, and n−1 previous audio frames) corresponding to the fixed time window. Thus, subsequent power calculations include n overlapping audio frames.

Figure 2D:
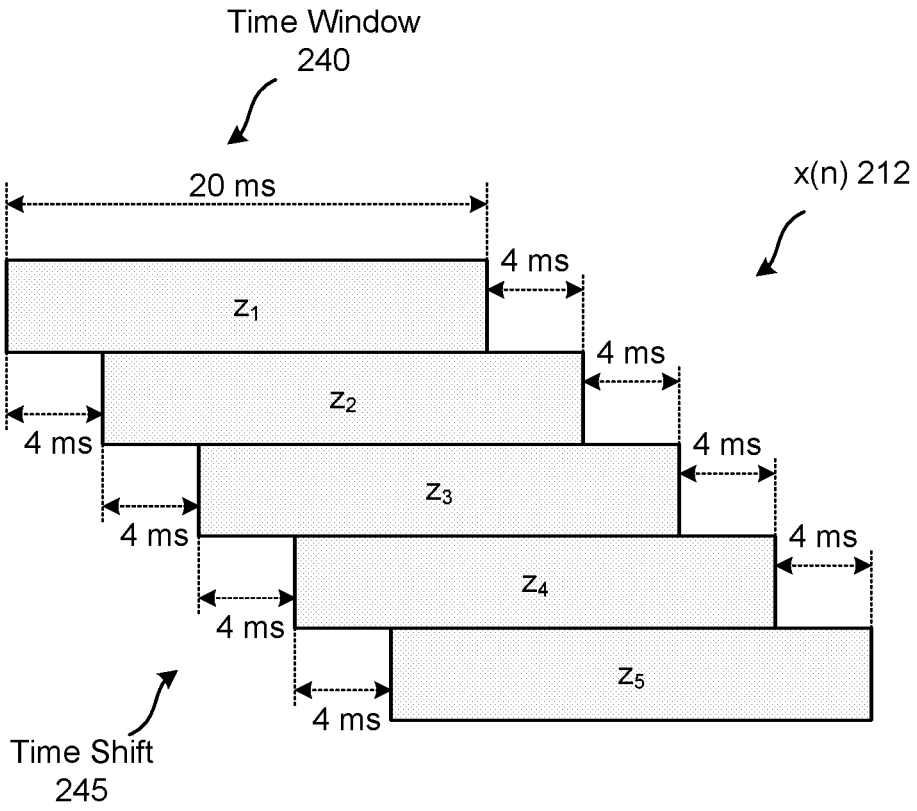

As illustrated in FIG. 2D, overlapping audio frames may be represented as overlapping audio data associated with a time window 240 (e.g., 20 ms) and a time shift 245 (e.g., 4 ms) between neighboring audio frames. For example, a first audio frame x1 may extend from 0 ms to 20 ms, a second audio frame x2 may extend from 4 ms to 24 ms, a third audio frame x3 may extend from 8 ms to 28 ms, and so on. Thus, the audio frames overlap by 80%, although the disclosure is not limited thereto and the time window 240 and the time shift 245 may vary without departing from the disclosure.

Figure 3:
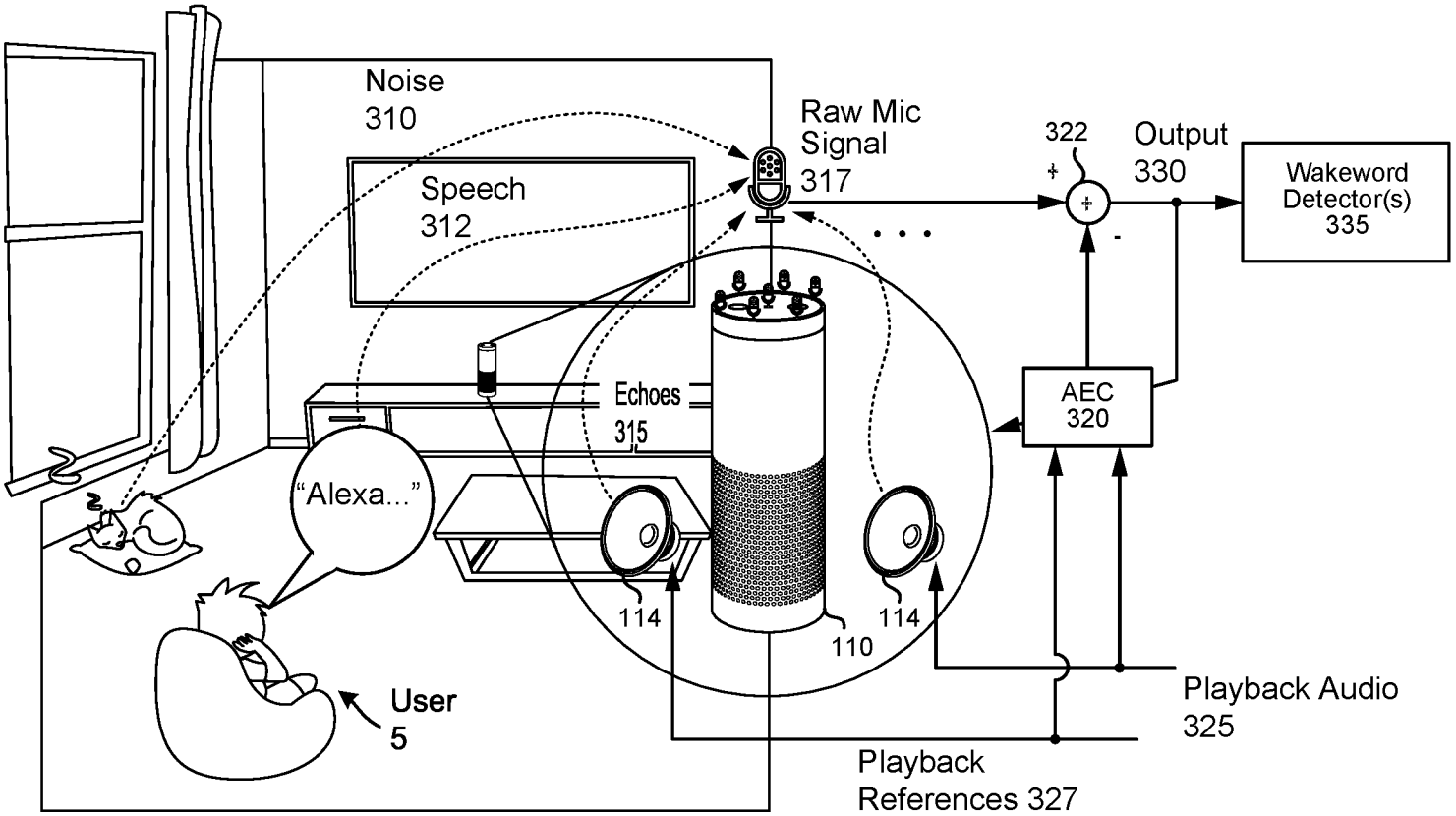
FIG. 3 illustrates a system for acoustic cancellation using one or more reference signals.

A device with multiple microphones, such as those discussed in reference to FIGS. 2A-2D may perform various operations to improve audio performance, for example beamforming to isolate and boost audio coming from a particular direction relative to a device 110. Even with multiple microphones, however, capturing audio data in a noisy environment is difficult. Noise and echoes from external audio sources make capturing and isolating desired audio difficult. For example, as shown in FIG. 3, it may be difficult for a device 110 to isolate desired speech 312 in a raw microphone signal 317 in view of other audio that may also be included in that signal such as noise 310 (for example as caused by a noise source such as the illustrated cat), echoes 315 of other audio, for example music being output by loudspeakers 114, or other non-desired audio. One technique for cancelling such undesired audio is using a reference signal to remove echo audio, called acoustic echo cancellation (AEC). Typically, this may involve an external reference signal, for example playback references 327 which represent the playback audio 325 being output by loudspeakers 114 and ultimately causing the echoes 315. Such playback references 327 (which may be a copy of the playback audio 325 or a representation thereof) may be sent to an AEC component 320 which will use filter coefficients to determine what aspects of the playback references 327 should be subtracted (cancelled) from the raw microphone signal 317 (for example using canceller 322) to determine output audio data 330. (Although the canceller 322 is illustrated as separate from the AEC 320, they may be part of a same component.) The resulting output audio data 330 may be sent to a downstream component such as WW detector 335 or other component.

As noted above, however, AEC that relies on an external reference signal may suffer from drawbacks including the inability to perform AEC in a situation where such an external reference signal is unavailable, complications due to nonlinearities, insufficient echo return loss enhancement (ERLE), requiring a separate system to cancel noise such as noise 310, or the like.

Figure 4:
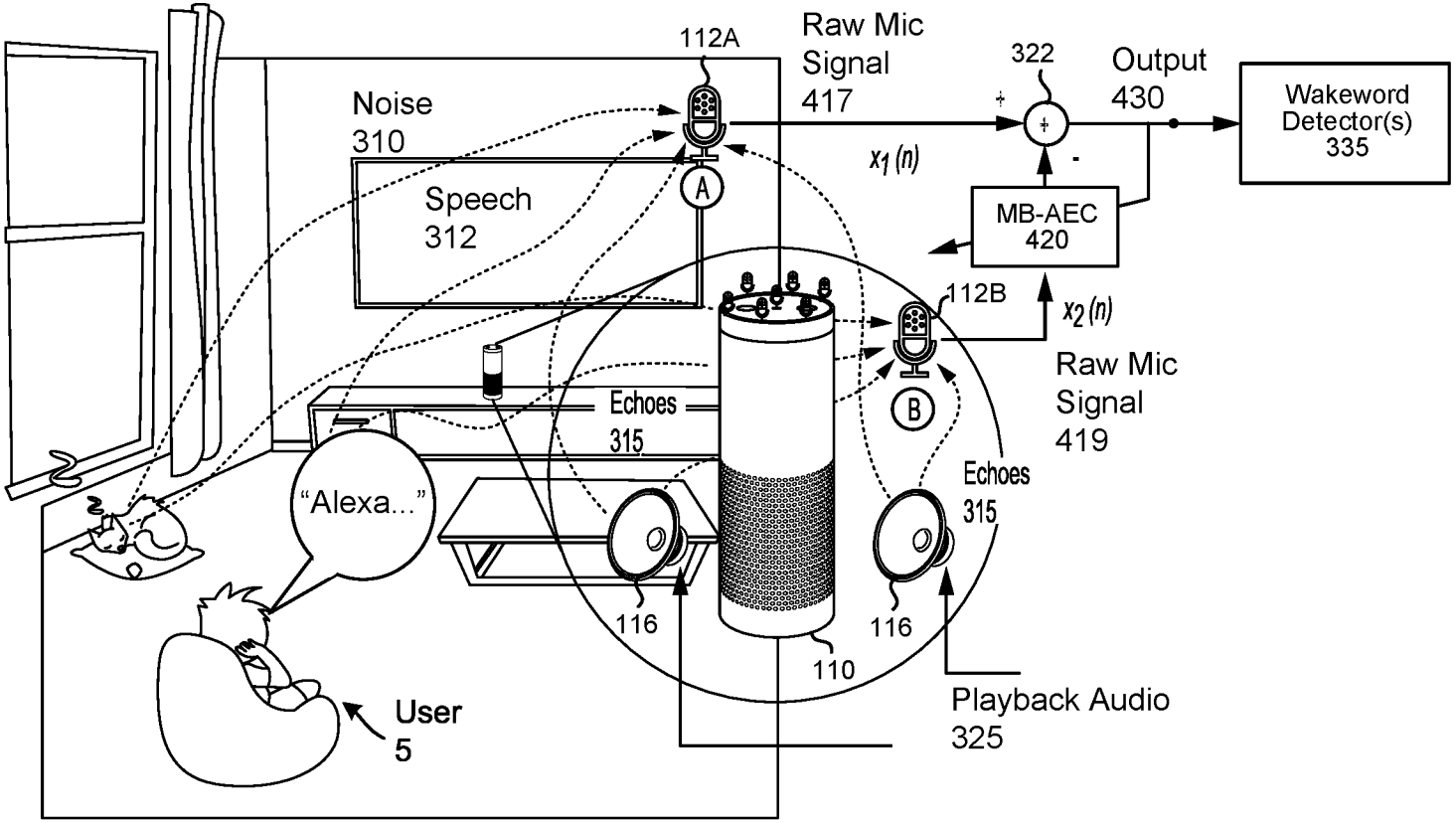
FIG. 4 illustrates a system for microphone-based acoustic echo cancellation according to embodiments of the present disclosure.

To improve upon this approach the present system may use an arrangement of microphone-based echo cancellation such as that shown in FIG. 4. As shown in FIG. 4, a device 110 may include multiple microphones 112. In the example of FIG. 4 a user 5 may be listening to music (represented by playback audio 325) that is output by loudspeakers 116. In this example the device 110 and/or system may not have access to an external playback reference signal 327. Alternatively, such an external reference signal may be available but may not necessarily be used for AEC according to the present embodiment. For purposes of illustration, loudspeakers 116 may be external loudspeakers from device 110, for example, may include a separate stereo system, speakers for a television, etc. As shown, the multiple microphones 112 of the device may each capture representations of the various audio in the room including the noise 310, speech 312, and echoes 315. While the device 110 may include multiple microphones, for present purposes only signals from two of those microphones are discussed with regard to FIG. 4. (Discussions below, for example with regard to FIG. 9, discuss operations with regard to additional microphones.) For example, microphone A 112A may capture a representation of noise 310, speech 312, echoes 315, etc. Microphone A's signal representing its captured audio at time n is illustrated as the first raw microphone signal $x_1(n)$ 417. Microphone B 112B may also capture a representation of noise 310, speech 312, echoes 315, etc. Microphone B's signal representing its captured audio at time n is illustrated as the second raw microphone signal $x_2(n)$ 419.

In this arrangement, the first raw microphone signal $x_1(n)$ 417 may be used as the primary signal, from which may be subtracted a representation of the second raw microphone signal $x_2(n)$ 419 as passed through the microphone-based acoustic echo cancellation (MB-AEC) component 420. Thus the AEC component 420 may use filter coefficients to determine what aspects of the second raw microphone signal $x_2(n)$ 419 should be subtracted (cancelled) from the first raw microphone signal $x_1(n)$ 417 (for example using canceller 322) to determine output audio data 430. (Although the canceller 322 is illustrated as separate from the AEC 420, they may be part of a same component.) The resulting output audio data 430 may be sent to a downstream component such as WW detector 335 or other component.

Figure 5:
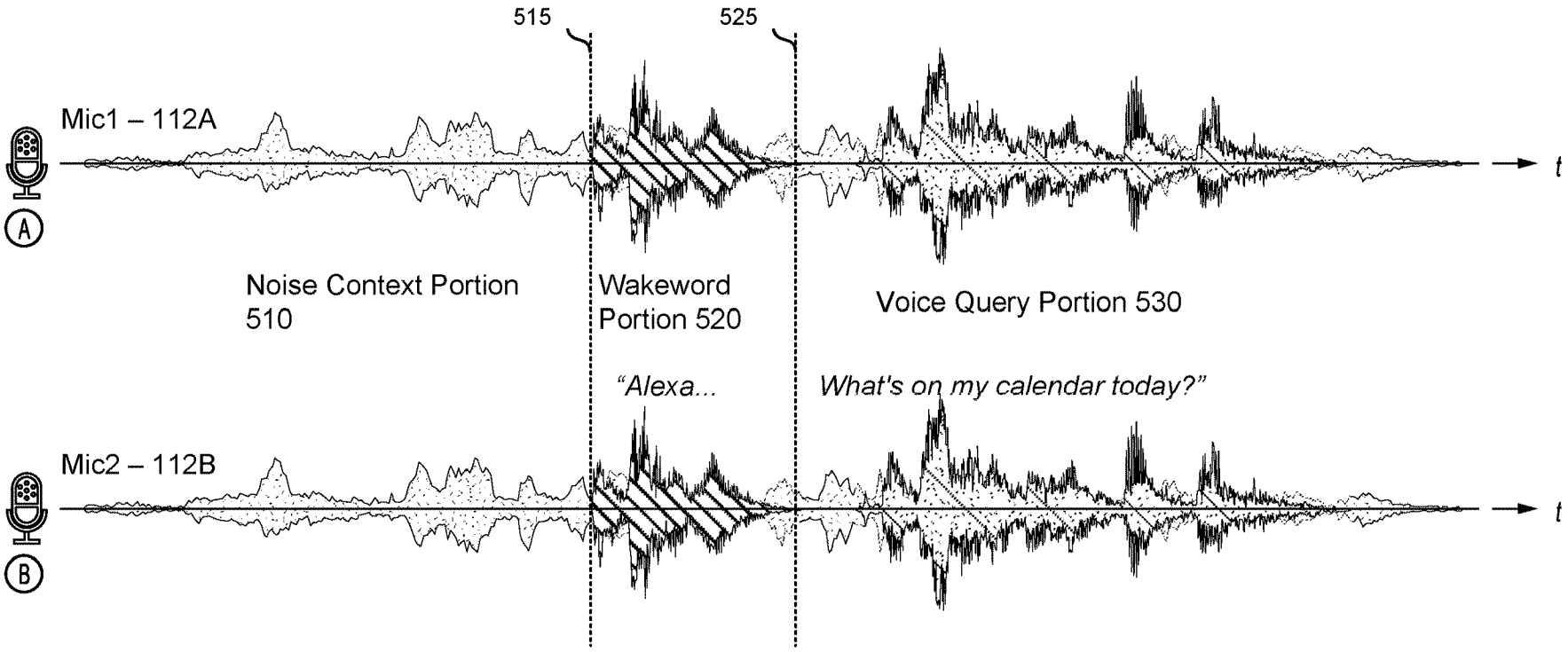
FIG. 5 illustrates detection of audio including a wakeword and voice query according to embodiments of the present disclosure.

As can be appreciated, due to the microphones' relative proximity to each other (each being part of device 110), their respective audio signals may be similar and may include similar representations of the captured audio in the environment of the device 110. If the device were to use the data from one microphone at one time/frame index (e.g., n=1) to cancel data from another microphone at the same time/frame index audio may be close to completely canceled. To avoid cancelling desired audio that is represented in both microphone audio signals (for example a desired wakeword, speech, or the like), the coefficients for the AEC 420 that were determined using one set of input audio frames may be delayed and then used to cancel audio for a later set of audio frames. For example, as shown in FIG. 5, cancellation filter coefficients determined for a noise context portion 510 (e.g., for audio that occurred before detection of a wakeword) may be used for AEC applied to later audio, such as AEC performed on audio corresponding to the wakeword portion 520 and/or the voice query portion 530. To do this, the device 110 may buffer filter coefficients determined for audio data and may hold them for a period of time. That period of time (also referred to as a delay) is configurable, but may correspond to various factors such as a typical echo path experienced by a device 110, a wakeword length, or the like. In one embodiment a device 110 may be configured with one or more default delay time periods that the device 110 may select from depending on operating conditions. Alternatively, or in addition, the device may determine its own delay time period as discussed below. In one example, the delay time period may correspond to 700 ms.

As the device 110 continues operations, it may apply buffered filter coefficients determined at an earlier time/frame index (e.g., n-d, where d is the delay) to audio of a microphone at a current time (e.g., $x_2(n)$) to determine data to be canceled from audio of another microphone at that same time (e.g., $x_1(n)$).

Figure 6A:
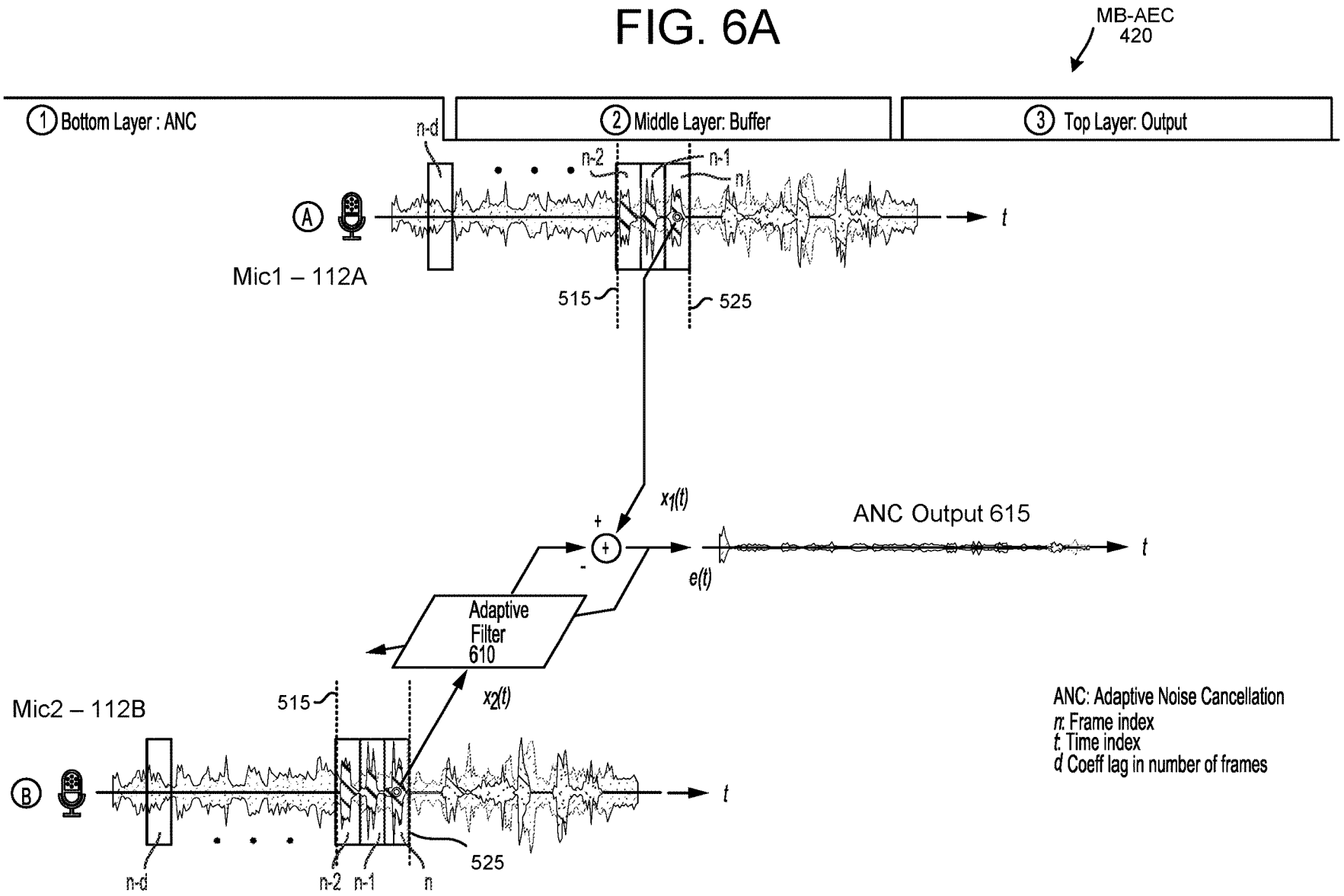
FIGS. 6A-6C illustrate components for performing microphone-based acoustic echo cancellation according to embodiments of the present disclosure.
Figure 6B:
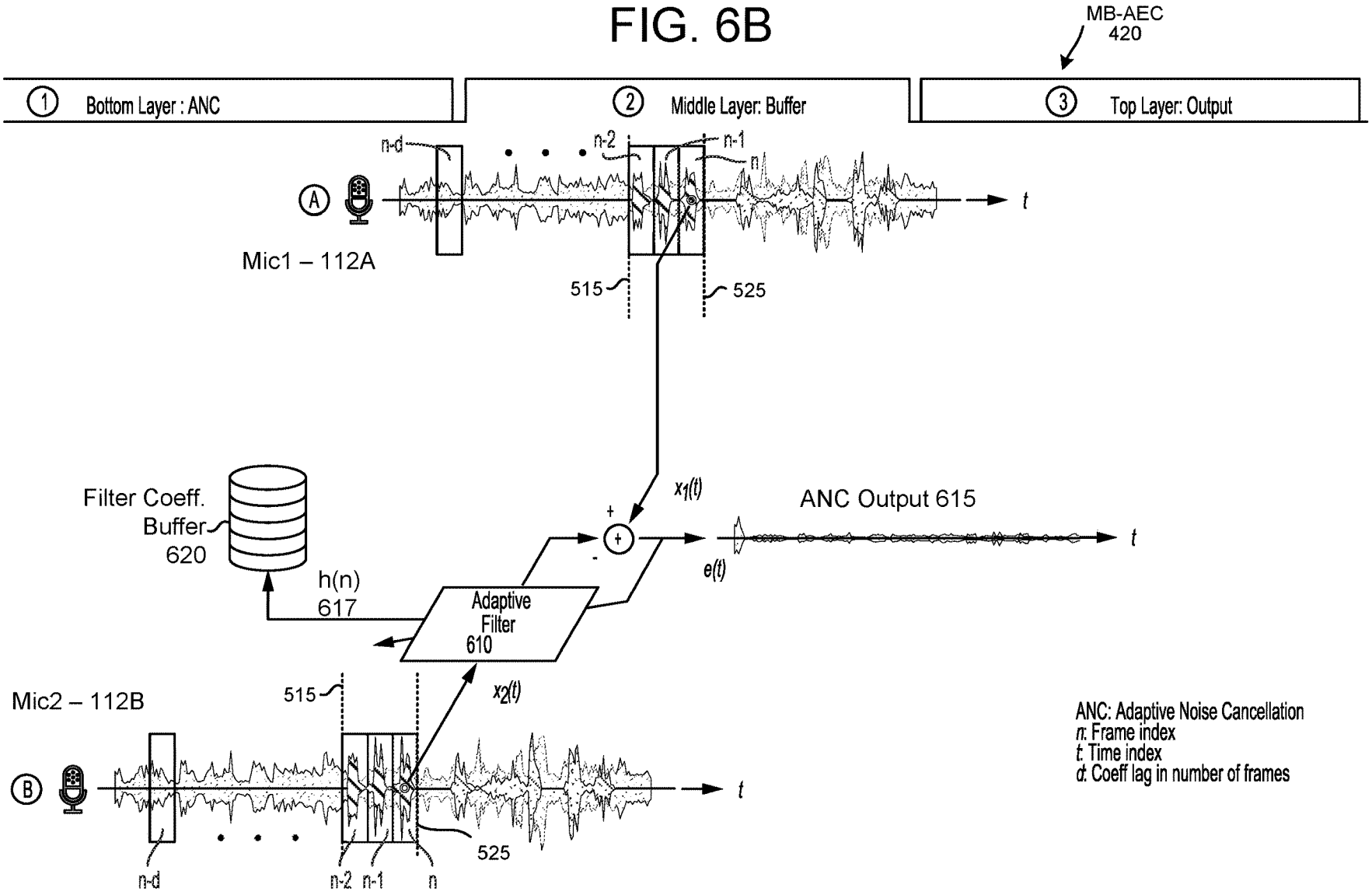
Figure 6C:
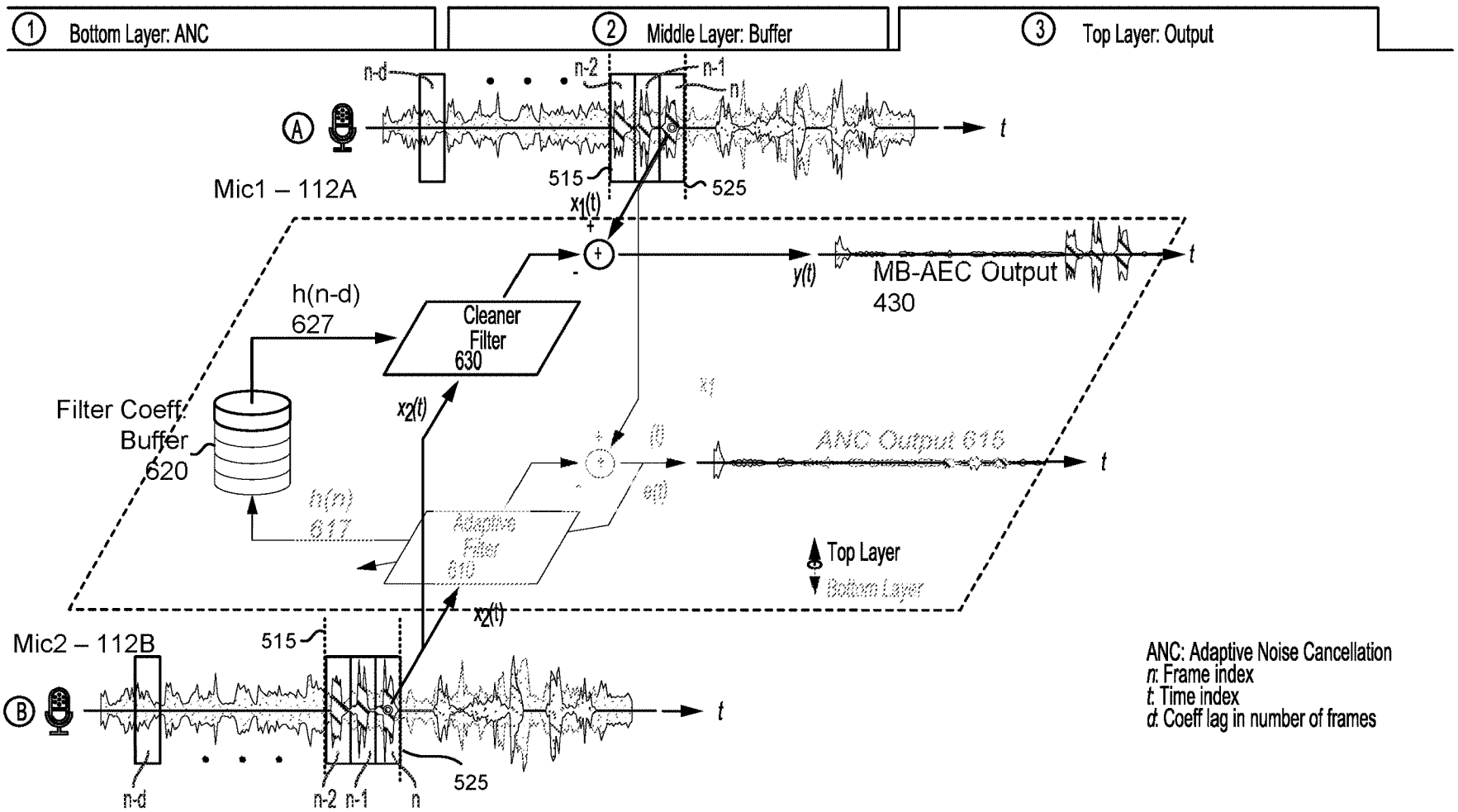

Components of an MB-AEC 420 to perform microphone-based acoustic echo cancellation are illustrated in FIG. 6A-6C. The bottom layer of the MB-AEC 420, shown in FIG. 6A, may include adaptive noise cancellation components, such as adaptive filter 610. The middle layer of the MB-AEC 420, shown in FIG. 6B, may include a filter coefficient buffer 620 which stores adaptive filter/noise cancellation coefficients. The top layer, shown in FIG. 6C, may include a cleaner filter 630 which may use delayed filter coefficients to perform audio cancellation to determine MB-AEC output 430.

First, to determine the proper filter coefficients for cancellation, the MB-AEC 420 may apply an adaptive filter configured to perform noise cancellation using two different microphone signals. Such an adaptive filter 610 is illustrated in FIG. 6A as the bottom layer of an MB-AEC 420 component. The adaptive filter 610 operates on audio signals corresponding to a same time/frame index. Thus, the adaptive filter 610 will attempt to cancel the audio signal from microphone 2 at time t ($x_2(t)$) from the microphone signal of microphone 1 at time t ($x_1(t)$). The adaptive filter 610 will continually adjust its coefficients to converge on values that will result in desired cancellation and a resulting close to zero output signal e(t). Thus, filter coefficients h of the adaptive filter 610 will be adjusted such that the value of e(t) (the ANC output 615) is minimized in the equation $x_1(t)-h(t)x_2(t)=e(t)$.

The adaptive filter 610 may utilize a short time Fourier transform-recursive least square (STFT-RLS) approach. The device 110 may use a least mean square solution (e.g., a normalized least mean square solution), a recursive D-square approach, and/or other approaches. The STFT of the microphone signals at frame n and STFT bin k may be represented as:

$$X_1(k,n),x_2(k,n) \triangleq [X_2(k,n)X_2(k,n-1) \ldots X_2(k,n-L+1)]^T \quad (1)$$

The adaptive filter 610 may an STFT sub-band finite impulse response (FIR) filter with coefficients h represented as:

$$h(k,n) \triangleq [H_0(k,n)H_1(k,n) \ldots H_{L-1}(k,n)]^T \quad (2)$$

The a-posterior error signal may be represented as:

$$\varepsilon(k,n) \triangleq X_1(k,n)-h^H(k,n)x_2(k,n) \quad (3)$$

and the recursive cost function represented as:

$$J\{h(k,n)\} \triangleq \sum_{i=0}^{n} \lambda^{n-i}|\varepsilon(k,i)|^2 \quad (4)$$

Take:

$$\partial J/\partial h^H(k,n)=R_{x_2x_2}(k,n)h(k,n)-r_{x_2x_1}(k,n)=0 \quad (5)$$

where $$R_{x_2x_2}(k,n) \triangleq \sum_{i=0}^{n} \lambda^{n-i}x_2(k,i)x_2^H(k,i) = \lambda R_{x_2x_2}(k,n-1)+x_2(k,n)x_2^H(k,n), \quad (6)$$

$$r_{x_2x_1}(k,n) \triangleq \sum_{i=0}^{n} \lambda^{n-i}x_2(k,i)X_1^*(k,i) = \lambda r_{x_2x_1}(k,n)+x_2(k,n)X_1^*(k,n)$$

The RLS solution for determining the coefficients h (at frame n and bin k) of the adaptive filter 610 may be represented as:

$$\hat{h}_{RLS}(k,n)=R_{x_2x_2}^{-1}(k,n)r_{x_2x_1}(k,n) \quad (7)$$

In addition to determining the filter coefficients h, the adaptive filter 610 may send the filter coefficients to a filter coefficient buffer 620, shown in FIG. 6B. As shown, after determination, the adaptive filter 610 may send the filter coefficients for frame n (e.g., h(n) 617) to the buffer 620. The buffer 620 may store the coefficients for that particular frame until they are called upon to be used by a cleaner filter, shown in FIG. 6C. As shown the cleaner filter 630 may receive from the buffer 620 the filter coefficients for a prior frame, represented as h(n−d) 627, where d is the delay. As noted above d may be configurable, and may equal an example value of 700 ms, an equivalent number of audio frames, or some other delay value. The cleaner filter 630 may thus apply those filter coefficients to the audio signal from microphone 2 112B and cancel the resulting value from the audio signal of microphone 1. Thus, the resulting MB-AEC output 430 y for frame n may be represented as:

$$y(n)=x_1(n)-h(n-d)x_2(n)=y(n) \quad (8)$$

Or, at frame n and bin k, as:

$$Y(k,n)=X_1(k,n)-\hat{h}_{RLS}^H(k,n-d)x_2(k-n) \quad (9)$$

Because the raw audio of the environment is captured by both microphones 1 112A and microphone 2 112B, the filter coefficients 617 determined by the adaptive filter 610 for purposes of noise cancellation are adapted to result in cancellation of the noise/echo/nonlinear distortion that may appear in the ambient audio, for example as represented by a noise context portion 510. When the echo cancellation is ultimately performed by MB-AEC 420, because the microphones capture signals with similar distortions, noise, echo, etc., such undesired audio is cancelled by the MB-AEC 420. Thus, in addition to performing AEC, the use of microphone signals to cancel each other as described herein also results in noise cancellation. Further, because the adaptive filter 610 may update its filter coefficients, it may account for any changing noise/echo in the environment of the device.

Figure 7:
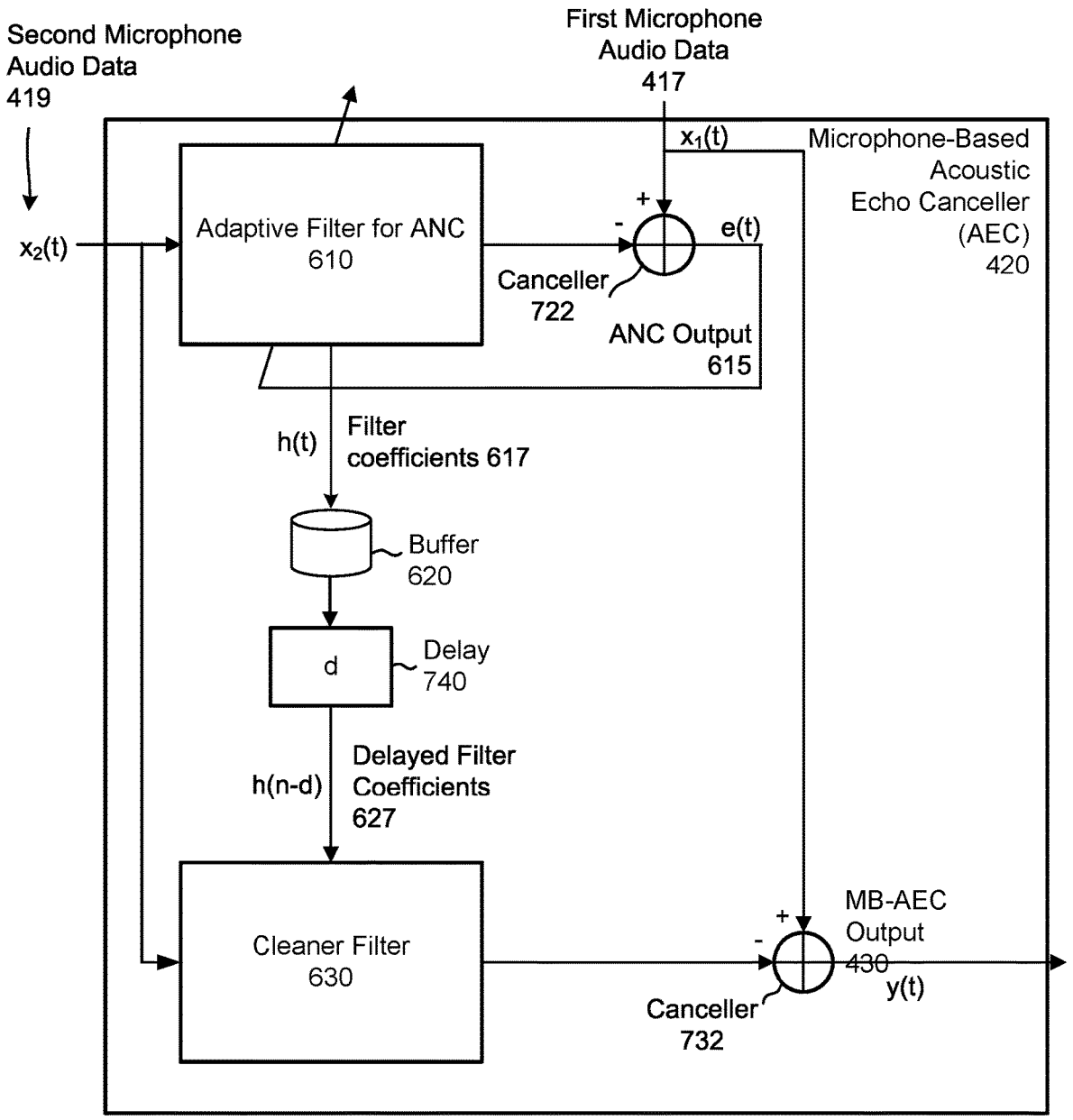
FIG. 7 illustrates an example component diagram for performing microphone-based acoustic echo cancellation according to embodiments of the present disclosure.

Another illustration of the MB-AEC component 420 is shown in FIG. 7. As shown, for a time frame t, the MB-AEC 420 may receive first microphone audio data $x_1(t)$ 417 and second microphone audio data $x_2(t)$ 419. (The audio for time frame t may correspond to an audio frame n.) The adaptive filter for ANC 610 may process the signal from the second microphone, the results of which are cancelled (by canceller 722) from the signal from the first microphone. The resulting ANC output 615 e(t) may be fed back into the adaptive filter 610 for purposes of adjusting the filter coefficients. The resulting filter coefficients 617 h(t) may be stored by buffer 620 and held for a delay time period, represented by delay component 740. The delayed filter coefficients 627 h(n−d) may be fed into the cleaner filter 630. Thus, at time t, when processing frame n, the cleaner filter may use filter coefficients for time frame n−d. The cleaner filter 630 may then apply those delayed filter coefficients to the second microphone audio data 419 and cancel the result from the first microphone audio data 417 (using canceller 732) to determine the MB-AEC output 430 y(t).

By using delayed filter coefficients (as opposed to using filter coefficients for a specific frame during that frame) the cancellation may be imperfect in that it may not result in complete cancellation of audio from one microphone signal to another. The cancellation will, however, likely remove the majority of noise/echo as the echo path/noise characteristics are unlikely to significantly vary from one audio frame to another. Thus, the noise/echo may be cancelled while desired audio, such as a wakeword, speech, etc., will not be.

The resulting MB-AEC output 430 y(t) may be operated on by a variety of downstream components such as VAD, WW detector 335, other speech processing components (such as those discussed below in reference to FIG. 10), or the like. For example, the MB-AEC output 430 may be processed by the WW detector 335 to determine a representation of a WW in the cancelled audio data/MB-AEC output 430. If a WW is detected, it may be desirable for the device 110 to pause adaptation of the coefficients of the adaptive filter 610 to allow desired audio (e.g., the wakeword and/or other speech) to be processed. Thus, if a WW detector 335 detects a WW, the device may continue to use the delayed filter coefficients 627 for some time period before continuing adaptation/determination of new filter coefficients.

For example, as shown in FIG. 5, a WW detector 335 may determine the beginning of a WW, 515. Upon detection of the beginning of the WW, the device 110 may freeze adaptation of the filter coefficients for some time period (e.g., 1 second, 5 seconds, a certain number of audio frames, etc.) so that the device 110 processes the wakeword portion 520 and voice query portion 530 using the same filter coefficients. Alternatively, or in addition, upon detection of an end of a WW (indicating by 525) by the WW detector 335 may freeze adaptation of the filter coefficients for some time period (e.g., 1 second, 5 seconds, a certain number of audio frames, etc.). Alternatively, or in addition, upon detection of the beginning of the WW, the device 110 may freeze adaptation of the filter coefficients until detection of the end of speech/a speech endpoint (for example by a VAD not shown), upon which the device 110 may resume adaptation/determination of new filter coefficients. For example, after speech is detected, a VAD or other component may determine that a certain number of audio frames do not include a representation of speech. The device may then indicate a speech endpoint if the number of non-speech audio frames satisfies a condition (e.g., exceeds a threshold or the like.) By freezing the coefficients in this manner the device 110 may avoid having the speech impact the filter coefficients used for echo cancellation (for example for d frames after the speech has begun), thus avoiding any undesired cancellation of desired speech. Depending on the downstream use of the cancelled audio, such as for AED, watermark detection, or the like, the timing/condition for freezing adaptation of the filter coefficients may vary. For example, if the cancelled audio is used for AED (for example by AED component 1040) the time for freezing the filter coefficients may correspond to a length of time of a particular acoustic event, after which the filter may resume coefficient adaptation. Other potential configurations are also possible.

In certain situations, operation of the MB-AEC 420 as described herein may be turned on or off depending on operating conditions such as power consumption, audio in an environment, etc. For example, if there is no audio being output by loudspeakers 114/audio sources 116 it may not be desirable to have ongoing operation of the MB-AEC 420. Thus, operation of the MB-AEC 420 may be turned on in response to determining a loudspeaker in an environment of the device is emitting audio (e.g., music, etc.). Further, operation of the MB-AEC 420 may be turned off in response to determining a loudspeaker of the environment is no longer emitting audio.

The value of the delay time period d as discussed herein may be a default value for a particular device 110 as determined by the device's manufacturer. For example, in one configuration, d may be approximately equal to 700 ms. The delay time period may also be expressed in terms of number of audio frames rather than time units. The delay time period value may be different for a device of one device type than for a device of a different device type. For example, a device with one particular microphone array configuration may use a different delay time period value than for a device with a different microphone array configuration. The delay time period value may be a default value as stored in memory of the device 110. In another embodiment the device 110 may include data, such as a table of potential delay time period values, that the device 110 may use depending on operation conditions of the environment of the device 110, for example, the acoustic conditions of the environment, echo path conditions, or the like may result in the device 110 selecting a particular delay time period value for use.

To determine a value of an acoustic characteristic of an environment (e.g., a room impulse response (RIR) of the environment), a device 110 may emit sounds at known frequencies (e.g., chirps, text-to-speech audio, music or spoken word content playback, etc.) to measure a reverberant signature of the environment to generate an RIR of the environment. Measured over time in an ongoing fashion, the device may be able to generate a consistent picture of the RIR and the reverberant qualities of the environment, thus better enabling the device to determine or approximate where it is located in relation to walls or corners of the environment (assuming the device is stationary). Further, if the device is moved, the device may be able to determine this change by noticing a change in the RIR pattern. Such acoustic characteristic data (which may include RIR data or other data) may represent the environment of the device and may assist in determination of a delay used for microphone-based AEC according to the present disclosure. For example, the device 110 may use the acoustic characteristic data to calculate a delay time period value, retrieve one from a lookup table, or otherwise determine a delay time period value. Determination of such data may occur over a period of time, for example during a time when the device 110 is not otherwise in use and may use audio that is outside the range of human hearing (e.g., below 20 Hz or above 20 kHz) to avoid disturbing a user.

Other than perhaps selection of the delay time period value, the operations herein may be similar across devices and environments, thus providing an effective and device-agnostic technique for performing echo cancellation.

Figure 8:
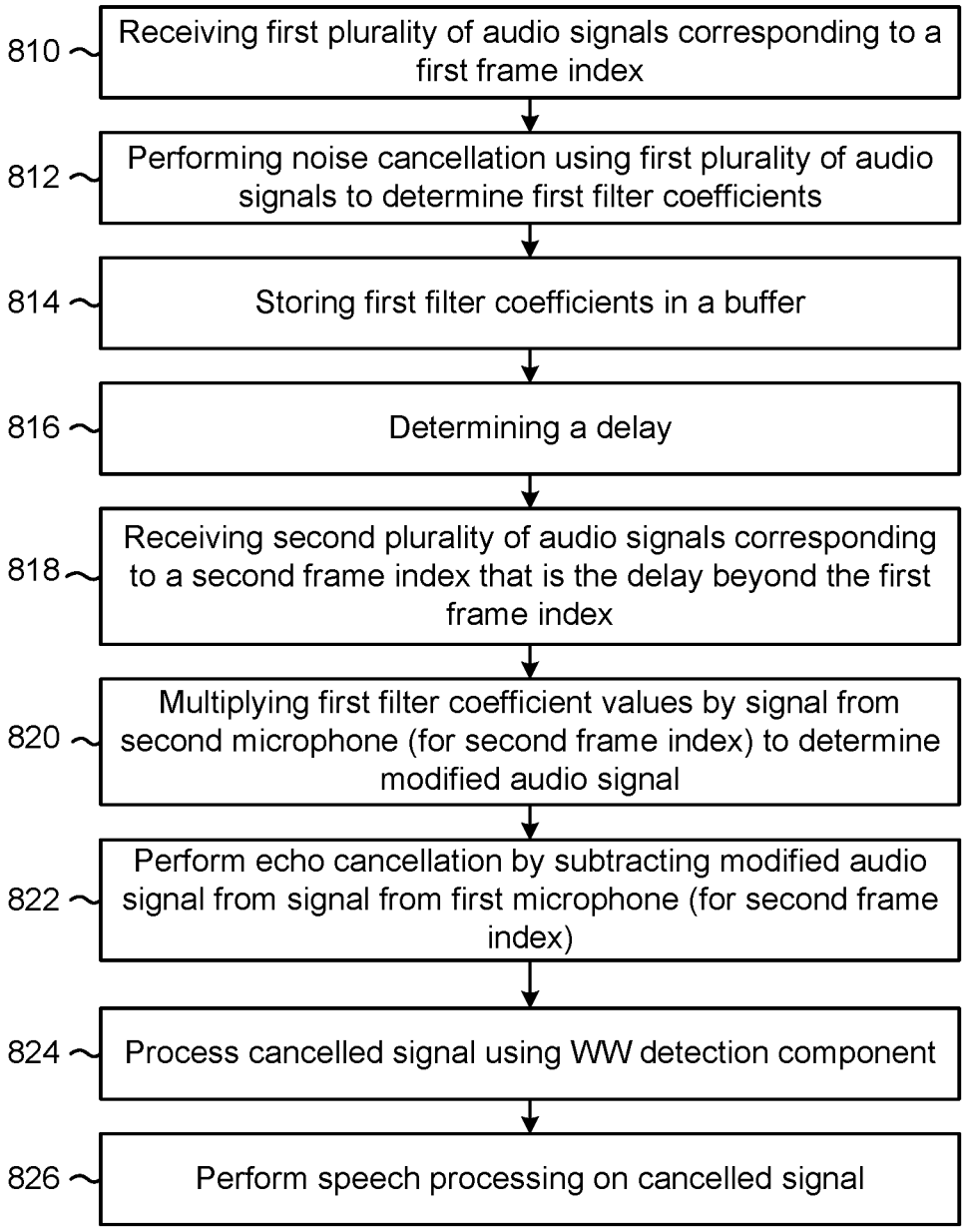
FIG. 8 is a flowchart describing operations of microphone-based acoustic echo cancellation according to embodiments of the present disclosure.

Thus, as shown in FIG. 8, the device 110 may receive (810) a first plurality of audio signals corresponding to a first frame index. The first plurality of audio signals may include a first audio signal from a first microphone 112A of a microphone array and a second audio signal from a second microphone 112B of the microphone array. The device 110 may then perform (812) noise cancellation using the first plurality of audio signals to determine first filter coefficients. For example, the device 110 may use bottom layer of an MB-AEC 420/an adaptive filter 610 to cancel the first audio signal and the second audio signal. In doing so the device 110 may determine first filter coefficients corresponding to the first frame index. The device may store (814) the first filter coefficients in a buffer, for example buffer 620. The device 110 may determine (816) a delay time period value, for example corresponding to delay 740/d. The device 110 may then receive (818), from the microphone array, a second plurality of audio signals corresponding to a second frame index. The second plurality of audio signals may include a third audio signal from the first microphone 112A of a microphone array and a fourth audio signal from the second microphone 112B. The second frame index may correspond to the delay time period after the first frame index. For example, if the second frame index is n, the first frame may correspond to n−d.

The device 110 may multiple (820) the first filter coefficient values by the fourth audio signal to determine a modified audio signal. For example, the device 110 may multiply the delayed filter coefficients 627 h(n−d) by $x_2(n)$ (if in the frequency domain) or convolving the filter coefficients 627 h(n−d) using $x_2(n)$ (if in the time domain) to determine a modified audio signal. The device may then perform (822) echo cancellation by subtracting the modified audio signal from the third audio signal. For example, the canceller may perform $x_1(n)-h(n-d)x_2(n)$ to determine MB-AEC output 430/cancelled signal y(n). The device may then process (824) the cancelled signal using a WW detection component 335 to determine a representation of a wakeword and may then perform (826) speech processing on the cancelled signal, for example using components discussed below in reference to FIG. 10.

While a single microphone's signal may act in lieu of an external reference signal, when a device has over 2 microphones (e.g., where there are M microphones and M>2), the device 110 may use M−1 microphone outputs in lieu of the external reference signal to predict acoustic echo in the first microphone output. Using multiple such signals as reference signals may result in improved ANC performance. The MB-AEC component 420 may thus treat echo cancellation as a noise reduction problem for wakeword detection. When there exist several (say Q≥1) external noise sources, the MB-AEC may need to deal with Q+1 sound (echo+noise) sources. According to the MINT (multichannel inverse) theorem, perfect noise/echo cancellation may only be possible when M−1≥Q+1=>M≥Q+2.

Figure 9:
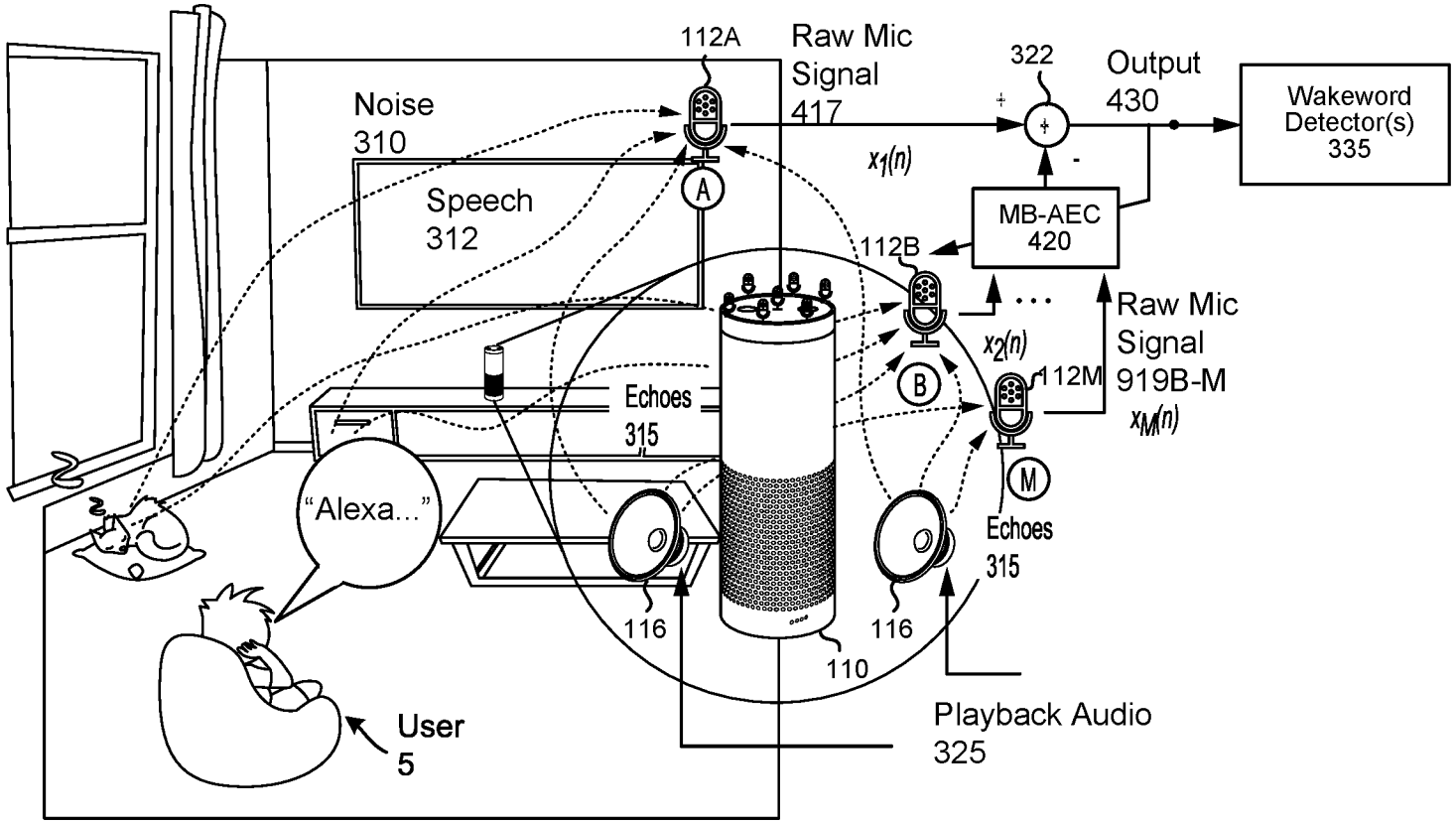
FIG. 9 illustrates a system for microphone-based acoustic echo cancellation for multiple microphone audio signals according to embodiments of the present disclosure.

Thus, as shown in FIG. 9, signals 919B $x_2(n)$ through 319M xM(n), corresponding to multiple microphones 112B through 112M, may be used by the MB-AEC 420 to cancel from signal 417 $x_1(n)$.

STFT of M where M≥2 at frame n and STFT bin k may be represented as:

$$X_1(k,n),x_m(k,n)\triangleq[X_m(k,n)X_m(k,n-1)\ \ldots\ X_m(k,n-L+1)]^T, m=2,\ldots,M \tag{10}$$

The adaptive filter 610 may an STFT sub-band finite impulse response (FIR) filter with coefficients h represented as:

$$h_m(k,n)\triangleq[H_{m,0}(k,n)H_{m,1}(k,n)\ \ldots\ H_{m,L-1}(k,n)]^T,\quad m=2,\ldots,M \tag{11}$$

$$h(k,n)\triangleq[h_2^T(k,n)\ \ldots\ h_M^T(k,n)]^T \tag{12}$$

The a-posterior error signal may be represented as:

$$\varepsilon(k,n)\triangleq X_1(k,n)-h^H(k,n)x_{2:M}(k,n) \tag{12}$$

where $$x_{2:M}(k,n)\triangleq[x_2^T(k,n)\ \ldots\ x_M^T(k,n)]^T$$

and the recursive cost function represented as:

$$J\{h(k,n)\}\triangleq\sum_{i=0}^{n}\lambda^{n-i}|\varepsilon(k,i)|^2 \tag{13}$$

The multiple microphone/multi-channel (Mc) recursive least square solution may be represented as:

$$\hat{h}_{McRLS}(k,n)=R_{x_{2:M}x_{2:M}}^{\dagger}(k,n)r_{x_{2:M}x_1}(k,n) \tag{14}$$

where $(\cdot)^{\dagger}$ denotes the pseudo-inverse of a square matrix and $$R_{x_{2:M}x_{2:M}}(k,n)\triangleq\sum_{i=0}^{n}\lambda^{n-i}x_{2:M}(k,i)x_{2:M}^H(k,i)=\lambda R_{x_{2:M}x_{2:M}}(k,n-1)+x_{2:M}(k,n)x_{2:M}^H(k,n), \tag{15}$$

$$r_{x_{2:M}x_1}(k,n)\triangleq\sum_{i=0}^{n}\lambda^{n-i}x_{2:M}(k,i)X_1^*(k,i)=\lambda r_{x_{2:M}x_1}(k,n)+x_{2:M}(k,n)X_1^*(k,n)$$

At frame n and bin k, the MB-AEC output 430 for multi-channel AEC may be represented as:

$$Y(k,n)=X_1(k,n)-\hat{h}_{McRLS}^H(k,n-d)x_{2:M}(k-n) \tag{16}$$

Thus, similar to equation 9 above with multi-channel matrices substituted in for single channel vectors where appropriate.

Figure 10:
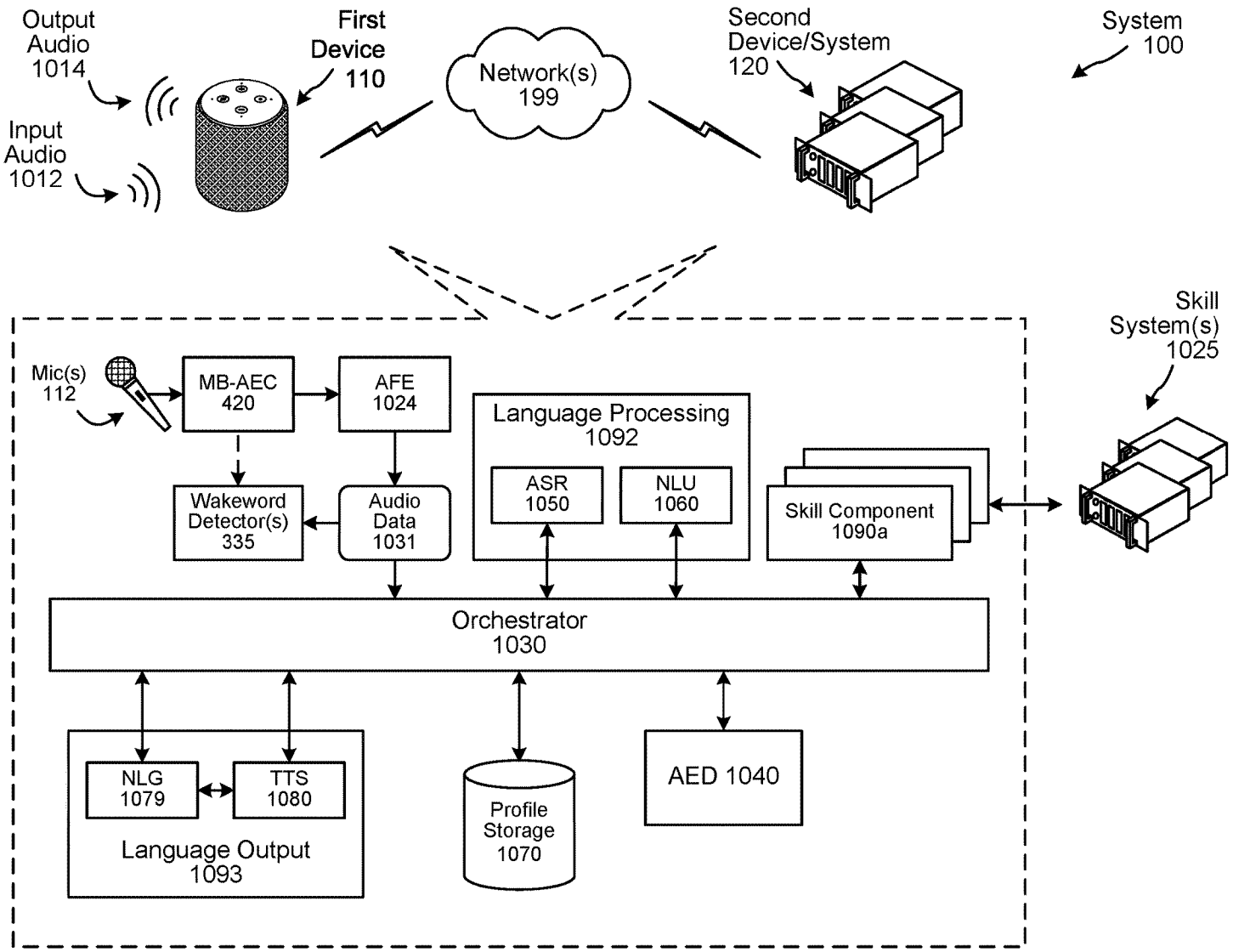
FIG. 10 is a conceptual diagram of components of a natural language processing system, according to embodiments of the present disclosure.

The system 100 may be a speech-processing/natural language processing system with the device 110 acting as a voice-controlled device. FIG. 10 is a conceptual diagram illustrating a high level overview of example components of the system 100 including features for processing natural language commands, according to embodiments of the present disclosure. In addition to the components previously described in the context of acoustic event detection, the system 100 may include components for performing speech processing and synthesis, as well as for responding to natural language commands. The system 100 may include a wakeword detector 335, an orchestrator component 1030, a profile storage 1070, language processing components 1092 including an ASR component 1050 and an NLU component 1060, language output components 1093 including an NLG component 1079 and a TTS component 1080, and/or one or more skill components 1090*a*, 1090*b*, 1090*c*, etc. (collectively "skill components 1090"), which may be in communication with one or more skill support systems 1025. The system 100 may provide output to a user in the form of synthesized speech, notification sounds, or other output audio 14.

The components may reside in the device 110 and/or second device/system 120 such that various functionality described herein may be performed by the device 110, the second device 120, or may be divided or shared between the two. For example, in some cases, the device 110 may process audio data locally, whereas in other cases the device 110 may send audio data to the system 120 for processing. In some implementations, the first device 110 may perform initial processing of input audio data 1012 and/or other input data, and send a form of intermittent data to the second device/system 120. As noted above, the input audio data 1012 may represent desired audio (such as speech) along with undesired audio (such as noise and/or echo). The intermittent data may include ASR data (such that audio data including a user's voice need not be sent from the user's device 110), update data pertaining to various models used by the first device 110, and/or commands to skill components 1090, etc.

The system may include an AEC component 420 for purposes of cancelling echo/noise as described herein. The system may also include an acoustic front end (AFE) 1024 which may operate on cancelled audio determined by the AEC component 420 for purposes of determining audio data 1031 for processing by the wakeword detector(s) 335. Alternatively, or in addition, audio data may be sent directly from the AEC component 420 to the wakeword detector(s) 335, AED 1040, or other downstream component.

The system 100 may process the audio data 1031 to determine whether speech is represented therein. The system 100 may use various techniques to determine whether the input audio data 1031 includes speech. In some examples, a voice-activity detector may apply voice-activity detection (VAD) techniques. Such VAD techniques may determine whether speech is present in audio data 1031 based on various quantitative aspects of the input audio data 1031, such as the spectral slope between one or more frames of the audio data; the energy levels of the audio data in one or more spectral bands; the signal-to-noise ratios of the audio data in one or more spectral bands; or other quantitative or qualitative aspects. In other examples, the system 100 may include a classifier configured to distinguish speech from background noise. The classifier may be implemented by techniques such as linear classifiers, support vector machines, and decision trees. In still other examples, the system 100 may apply hidden Markov model (HMM) or Gaussian mixture model (GMM) techniques to compare the audio data to one or more acoustic models in storage, which acoustic models may include models corresponding to speech, noise (e.g., environmental noise or background noise), or silence. Still other techniques may be used to determine whether speech is present in audio data.

The wakeword detector(s) 335 may compare audio data to stored models or data to detect a wakeword. One approach for wakeword detection applies general large vocabulary continuous speech recognition (LVCSR) systems to decode audio signals, with wakeword searching being conducted in the resulting lattices or confusion networks. LVCSR decoding may require relatively high computational resources. Another approach for wakeword detection builds HMMs for each wakeword and non-wakeword speech signals, respectively. The non-wakeword speech includes other spoken words, background noise, etc. There can be one or more HMMs built to model the non-wakeword speech characteristics, which are named filler models. Viterbi decoding is used to search the best path in the decoding graph, and the decoding output is further processed to make the decision on wakeword presence. This approach can be extended to include discriminative information by incorporating a hybrid DNN-HMM decoding framework. In another example, the wakeword detector 335 may be built on deep neural network (DNN)/recursive neural network (RNN) structures directly, without HMM being involved. Such an architecture may estimate the posteriors of wakewords with context information, either by stacking frames within a context window for DNN, or using RNN. Follow-on posterior threshold tuning or smoothing is applied for decision making. Other techniques for wakeword detection, such as those known in the art, may also be used.

In various embodiments, the wakeword detector(s) 335 may use one of a plurality of wakeword-detection models. Each model may be trained to detect a different wakeword. In some embodiments, a single model may detect multiple wakewords. Each wakeword may be associated with a different speech-processing system and/or different speech-processing system configurations (e.g., representing different virtual assistants available to the user via the system 100). Upon detection of a particular wakeword, the system 100 may process the audio data 1031 by the corresponding speech-processing system configuration.

In various embodiments, the wakeword-detection model of the wakeword detector(s) 335 is implemented to detect wakewords spoken in different accents corresponding to different countries, regions, or other areas. For example, the wakeword-detection model may be implemented to detect the wakeword "Alexa" whether it is spoken in an Indian, Scottish, or Australian accent. The wakeword-detection model may be also implemented to detect other wakewords in other languages; these other languages may have similar variations in accents that the wakeword-detection model may be similarly implemented to detect.

The wakeword detector(s) 335 may determine a similarity score for the candidate wakeword based on how similar it is to the stored wakeword; if the similarly score is higher than the wakeword-detection threshold, the wakeword detector 335 may determine that the wakeword is present in the audio data, and if the similarity score is less than the wakeword-detection threshold, the wakeword detector 335 may determine that the wakeword not is present in the audio data. For example, if the candidate wakeword matches the stored wakeword very closely, the wakeword detector 335 may determine a similarity score of 100; if the candidate wakeword does not match the stored wakeword at all, the wakeword detector 335 may determine a similarity score of 0. If the wakeword detector 335 determines candidate wakeword partially matches the stored wakeword, it may determine an intermediate similarity score, such as 75 or 85. Though the disclosure herein describes a similarity score of 0-100, wherein zero is least similar and 100 is most similar. The present disclosure is not limited to any particular range of values of the similarity score, and any system or method of determining similarity between a candidate wakeword represented in captured audio data and a stored representation of the wakeword is within the scope of the present disclosure.

Once a wakeword is detected by the wakeword detector(s) 335, the system 100 may begin processing speech represented in the audio data 1031. The system 100 may send the audio data 1031 to an orchestrator component 1030. The orchestrator component 1030 may include memory and logic that enables it to transmit various pieces and forms of data to various components of the system, as well as perform other operations as described herein. The orchestrator component 1030 may be or include a speech-processing system manager, which may be used to determine which, if any, of the language processing components 1092, language output components 1093, and/or skill components 1090 should receive and/or process the audio data 1031 and/or data derived therefrom (e.g., by ASR, NLU, and/or entity resolution).

In some embodiments, the orchestrator component 1030 and/or speech-processing system manager communicate with the language processing components 1092 using an application programming interface (API). The API may be used to send and/or receive data, commands, or other information to and/or from the language processing components 1092. For example, the orchestrator component 1030 may send, via the API, the input audio data 1031 to language processing components 1092 elected by the speech-processing system manager and may receive, from the selected language processing components 1092, a command and/or data responsive to the audio data 1031.

The language processing components 1092 may include an ASR component 1050, which may transcribe the input audio data 1031 into text data. The text data output by the ASR component 1050 may represent one or more than one (e.g., in the form of an N-best list) ASR hypotheses representing speech represented in the input audio data 1031. The ASR component 1050 may interpret the speech in the input audio data 1031 based on a similarity between the audio data 1031 and pre-established language models. For example, the ASR component 1050 may compare the input audio data 1031 with models for sounds (e.g., acoustic units such as phonemes, senons, phones, etc.) and sequences of sounds to identify words that match the sequence of sounds of the speech represented in the input audio data 1031. The ASR component 1050 may the text data generated thereby to an NLU component 1060, via, in some embodiments, the orchestrator component 1030. The text data sent from the ASR component 1050 to the NLU component 1060 may include a single top-scoring ASR hypothesis or may include an N-best list including multiple top-scoring ASR hypotheses. An N-best list may additionally include a respective score associated with each ASR hypothesis represented therein.

The language processing components 1092 may further include a NLU component 1060 that attempts to make a semantic interpretation of the phrase(s) or statement(s) represented in the text data input therein by determining one or more meanings associated with the phrase(s) or statement(s) represented in the text data. The NLU component 1060 may determine an intent representing an action that a user desires be performed and may determine information that allows a device (e.g., the user device 110, the system(s) 120, a skill component 1090, a skill system(s) 1025, etc.) to execute the intent. For example, if the text data corresponds to "play Africa by Toto," the NLU component 1060 may determine an intent that the system output music and may identify "Toto" as an artist and "Africa" as the song. For further example, if the text data corresponds to "what is the weather," the NLU component 1060 may determine an intent that the system output weather information associated with a geographic location of the user device 110. In another example, if the text data corresponds to "turn off the lights," the NLU component 1060 may determine an intent that the system turn off lights associated with the user device 110 or its user.

The NLU results data may be sent (via, for example, the orchestrator component 1030) from the NLU component 1060 (which may include tagged text data, indicators of intent, etc.) to a skill component(s) 1090. If the NLU results data includes a single NLU hypothesis, the NLU component 1060 may send the NLU results data to the skill component(s) 1090 associated with the NLU hypothesis. If the NLU results data includes an N-best list of NLU hypotheses, the NLU component 1060 may send the top scoring NLU hypothesis to a skill component(s) 1090 associated with the top scoring NLU hypothesis. In some implementations, the NLU component 1060 and/or skill component 1090 may determine, using the interaction score, text data representing an indication of a handoff from one set of language processing components 1092 to another (e.g., corresponding to a different virtual assistant profile).

A skill component 1090 may be software running on or in conjunction with the system 100 that is, or is similar to, a software application. A skill component 1090 may enable the system 100 to execute specific functionality in order to provide data or produce some other requested output. The system 100 may be configured with more than one skill component 1090. For example, a weather service skill component may enable the system 100 to provide weather information, a car service skill component may enable the system 100 to book a trip with respect to a taxi or ride sharing service, a restaurant skill component may enable the system 100 to order a pizza with respect to the restaurant's online ordering system, etc. A skill component 1090 may operate in conjunction between the system(s) 120 and other devices, such as the user device 110, in order to complete certain functions. Inputs to a skill component 1090 may come from speech processing interactions or through other interactions or input sources. A skill component 1090 may include hardware, software, firmware, or the like that may be dedicated to a particular skill component 1090 or shared among different skill components 1090.

Skill support system(s) 1025 may communicate with a skill component(s) 1090 within the system(s) 120 directly and/or via the orchestrator component 1030. A skill support system(s) 1025 may be configured to perform one or more actions. A skill may enable a skill support system(s) 1025 to execute specific functionality in order to provide data or perform some other action requested by a user. For example, a weather service skill may enable a skill support system(s) 1025 to provide weather information to the system(s) 120, a car service skill may enable a skill support system(s) 1025 to book a trip with respect to a taxi or ride sharing service, an order pizza skill may enable a skill support system(s) 1025 to order a pizza with respect to a restaurant's online ordering system, etc. Additional types of skills include home automation skills (e.g., skills that enable a user to control home devices such as lights, door locks, cameras, thermostats, etc.), entertainment device skills (e.g., skills that enable a user to control entertainment devices such as smart televisions), video skills, flash briefing skills, as well as custom skills that are not associated with any pre-configured type of skill. The system 100 may include a skill component 1090 dedicated to interacting with the skill support system(s) 1025. A skill, skill device, or skill component may include a skill component 1090 operated by the system 100 and/or skill operated by the skill support system(s) 1025.

The system 100 may include language output components 1093 including a natural language generation component 1079 and/or a TTS component 1080. The TTS component 1080 may generate audio data (e.g., synthesized speech) from text data using one or more different methods. Text data input to the TTS component 1080 may come from a skill component 1090, the orchestrator component 1030, and/or another component of the system. The text data may include an indication of a speech-processing component and/or data responsive to a command. Audio data determined by the language output component 1093 may be sent to device 110 and output as output audio 1014 responsive to an input command.

The system 100 may include profile storage 1070. The profile storage 1070 may include a variety of information related to individual users, groups of users, devices, etc. that interact with the system. A "profile" refers to a set of data associated with a user, device, etc. The data of a profile may include preferences specific to the user, device, etc.; input and output capabilities of the device; internet connectivity information; user bibliographic information; subscription information, as well as other information. The profile storage 1070 may include one or more user profiles, with each user profile being associated with a different user identifier. Each user profile may include various user identifying information. Each user profile may also include preferences of the user and/or one or more device identifiers, representing one or more devices of the user. When a user logs into to, for example, an application installed on the device 110, the user profile (associated with the presented login information) may be updated to include information about the device 110. As described, the profile storage 1070 may further include data that shows an interaction history of a user, including commands and times of receipt of commands. The profile storage 1070 may further include data that shows when a second user was present to hear an indication of a handoff for a command uttered by a first user.

The profile storage 1070 may include one or more group profiles. Each group profile may be associated with a different group identifier. A group profile may be specific to a group of users. That is, a group profile may be associated with two or more individual user profiles. For example, a group profile may be a household profile that is associated with user profiles associated with multiple users of a single household. A group profile may include preferences shared by all the user profiles associated therewith. Each user profile associated with a group profile may additionally include preferences specific to the user associated therewith. That is, each user profile may include preferences unique from one or more other user profiles associated with the same group profile. A user profile may be a stand-alone profile or may be associated with a group profile.

The profile storage 1070 may include one or more device profiles. Each device profile may be associated with a different device identifier. Each device profile may include various device identifying information. Each device profile may also include one or more user identifiers, representing one or more users associated with the device. For example, a household device's profile may include the user identifiers of users of the household.

The system 100 may be configured to incorporate user permissions and may only perform activities disclosed herein if approved by a user. As such, the systems, devices, components, and techniques described herein would be typically configured to restrict processing where appropriate and only process user information in a manner that ensures compliance with all appropriate laws, regulations, standards, and the like. The system and techniques can be implemented on a geographic basis to ensure compliance with laws in various jurisdictions and entities in which the components of the system and/or user are located.

The system 100 may include components for performing audio event detection (AED) and/or generating notifications to a user. AED relates to processing audio data 1031 representing a sound, such as a non-speech sound, to determine when and if a particular acoustic event is represented in the audio data. An AED system/component may be used as part of a smart home system or an alarm system that may detect and possibly take one or more actions in response to detecting an acoustic event. An AED component, such as AED 1040 may be configured to detect and act upon different types of acoustic events. An acoustic event may be an event identified in the presence of an acoustic background (e.g., background noise) represented in audio data; for example, and without limitation, a door opening, a doorbell ringing, breaking glass, footsteps, a baby crying, a smoke alarm, coughing, barking, etc. Such acoustic events may be distinguished from uneventful background noise such as wind, traffic, HVAC equipment, etc. The AED component 1040 may respond to a detected event by turning on a light, adjusting environmental settings, triggering an alarm, sending a notification to a user, recording video using a camera, etc.

The AED component 1040 may receive audio data 1031 from the AFE 1024 and/or MB-AEC 420. This audio data 1031 may be a digital representation of an analog audio signal and may be sampled at, for example, 256 kHz. The AED component 1040 may instead or in addition receive acoustic feature data, which may include one or more log filterbank energy (LFBE) and/or Mel-frequency cepstrum coefficient (MFCC) vectors, from the acoustic front end 1024. The audio data 1031 may include frames, where each frame may represent audio data or audio features for segment of audio data; for example, 30 ms. The AED component 1040 may process the audio data in blocks; for example, where a block represents 1s, 3s, 5s, 10s, or some other duration of audio. The audio data may be processed in portions such as a first portion, a second portion, etc. Each portion of the audio data may correspond to one or more frames.

The AED component 1040 may include an event classifier which may classify incoming audio data/feature data with respect to whether such data represents an acoustic event that the classifier is trained to recognized. The AED component 1040 may include additional models such as one or more convolutional neural networks (CRNNs) and/or long short-term memory networks (LSTMs) for detecting prebuild and/or custom sounds. The AED component 1040 may output an indication of detection of an event as event data. Such event data may include an identifier of the detected event, a score corresponding to the likelihood of detection, or other related data. Such event data may then be sent over network 199 and/or to a downstream component, for example a notification system(s)/event notification component (not shown) or another device.

Figure 11:
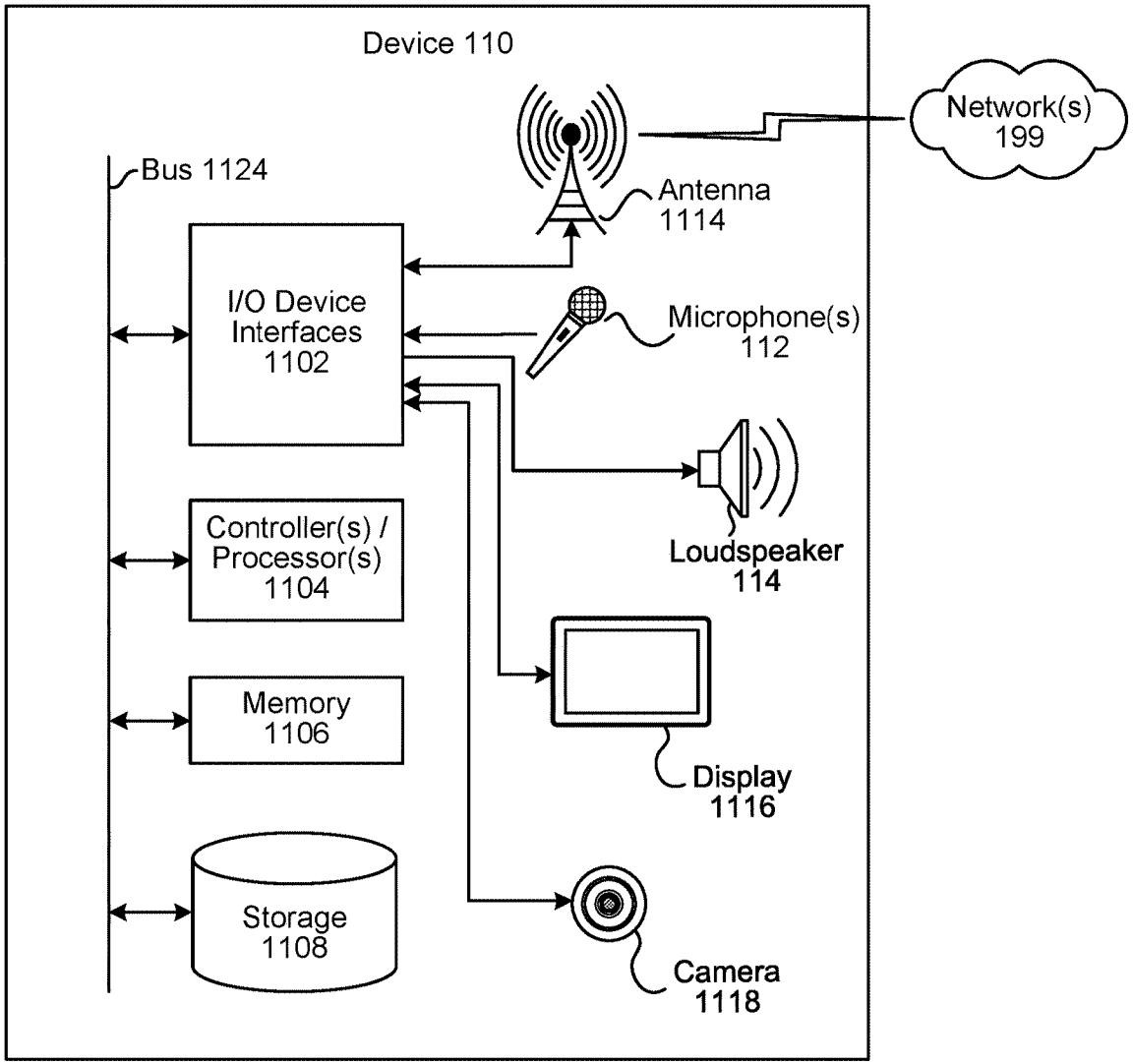
FIG. 11 is a block diagram conceptually illustrating example components of a device, according to embodiments of the present disclosure.
Figure 12:
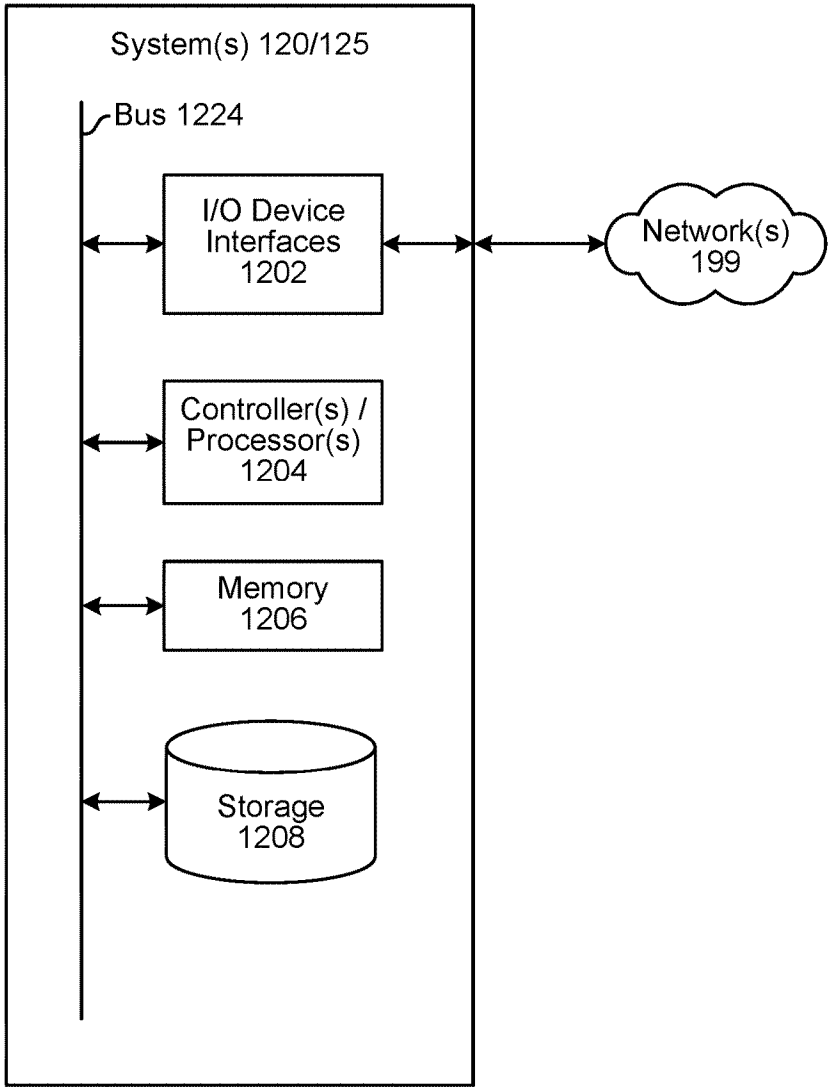
FIG. 12 is a block diagram conceptually illustrating example components of a system, according to embodiments of the present disclosure.

FIG. 11 is a block diagram conceptually illustrating a device 110 that may be used with the remote system 120. FIG. 12 is a block diagram conceptually illustrating example components of a remote device, such as the remote system 120, which may assist with ASR processing, NLU processing, etc.; and a skill component 125. A system (120/125) may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The remote system 120 may be configured to operate using one or more of a client-server model, a computer bureau model, grid computing techniques, fog computing techniques, mainframe techniques, utility computing techniques, a peer-to-peer model, sandbox techniques, or other computing techniques.

Multiple systems (120/125) may be included in the system 100 of the present disclosure, such as one or more remote systems 120 for performing ASR processing, one or more remote systems 120 for performing NLU processing, and one or more skill component 125, etc. In operation, each of these systems may include computer-readable and computer-executable instructions that reside on the respective device (120/125), as will be discussed further below.

Each of these devices (110/120/125) may include one or more controllers/processors (1104/1204), which may each include a central processing unit (CPU) for processing data and computer-readable instructions, and a memory (1106/1206) for storing data and instructions of the respective device. The memories (1106/1206) may individually include volatile random access memory (RAM), non-volatile read only memory (ROM), non-volatile magnetoresistive memory (MRAM), and/or other types of memory. Each device (110/120/125) may also include a data storage component (1108/1208) for storing data and controller/processor-executable instructions. Each data storage component (1108/1208) may individually include one or more non-volatile storage types such as magnetic storage, optical storage, solid-state storage, etc. Each device (110/120/125) may also be connected to removable or external non-volatile memory and/or storage (such as a removable memory card, memory key drive, networked storage, etc.) through respective input/output device interfaces (1102/1202).

Computer instructions for operating each device (110/120/125) and its various components may be executed by the respective device's controller(s)/processor(s) (1104/1204), using the memory (1106/1206) as temporary "working" storage at runtime. A device's computer instructions may be stored in a non-transitory manner in non-volatile memory (1106/1206), storage (1108/1208), or an external device(s). Alternatively, some or all of the executable instructions may be embedded in hardware or firmware on the respective device in addition to or instead of software.

Each device (110/120/125) includes input/output device interfaces (1102/1202). A variety of components may be connected through the input/output device interfaces (1102/1202), as will be discussed further below. Additionally, each device (110/120/125) may include an address/data bus (1124/1224) for conveying data among components of the respective device. Each component within a device (110/120/125) may also be directly connected to other components in addition to (or instead of) being connected to other components across the bus (1124/1224).

Referring to FIG. 11, the device 110 may include input/output device interfaces 1102 that connect to a variety of components such as an audio output component such as a speaker 1112, a wired headset or a wireless headset (not illustrated), or other component capable of outputting audio. The device 110 may also include an audio capture component. The audio capture component may be, for example, a microphone 112 or array of microphones, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 1116 for displaying content. The device 110 may further include a camera 1118.

Via antenna(s) 1114, the input/output device interfaces 1102 may connect to one or more networks 199 via a wireless local area network (WLAN) (such as Wi-Fi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (1102/1202) may also include communication components that allow data to be exchanged between devices such as different physical servers in a collection of servers or other components.

The components of the device 110, the remote system 120, and/or a skill component 125 may include their own dedicated processors, memory, and/or storage. Alternatively, one or more of the components of the device 110, the remote system 120, and/or a skill component 125 may utilize the I/O interfaces (1102/1202), processor(s) (1104/1204), memory (1106/1206), and/or storage (1108/1208) of the device(s) 110, system 120, or the skill component 125, respectively. Thus, the ASR component 1050 may have its own I/O interface(s), processor(s), memory, and/or storage; the NLU component 1060 may have its own I/O interface(s), processor(s), memory, and/or storage; and so forth for the various components discussed herein.

As noted above, multiple devices may be employed in a single system. In such a multi-device system, each of the devices may include different components for performing different aspects of the system's processing. The multiple devices may include overlapping components. The components of the device 110, the remote system 120, and a skill component 125, as described herein, are illustrative, and may be located as a stand-alone device or may be included, in whole or in part, as a component of a larger device or system.

Figure 13:
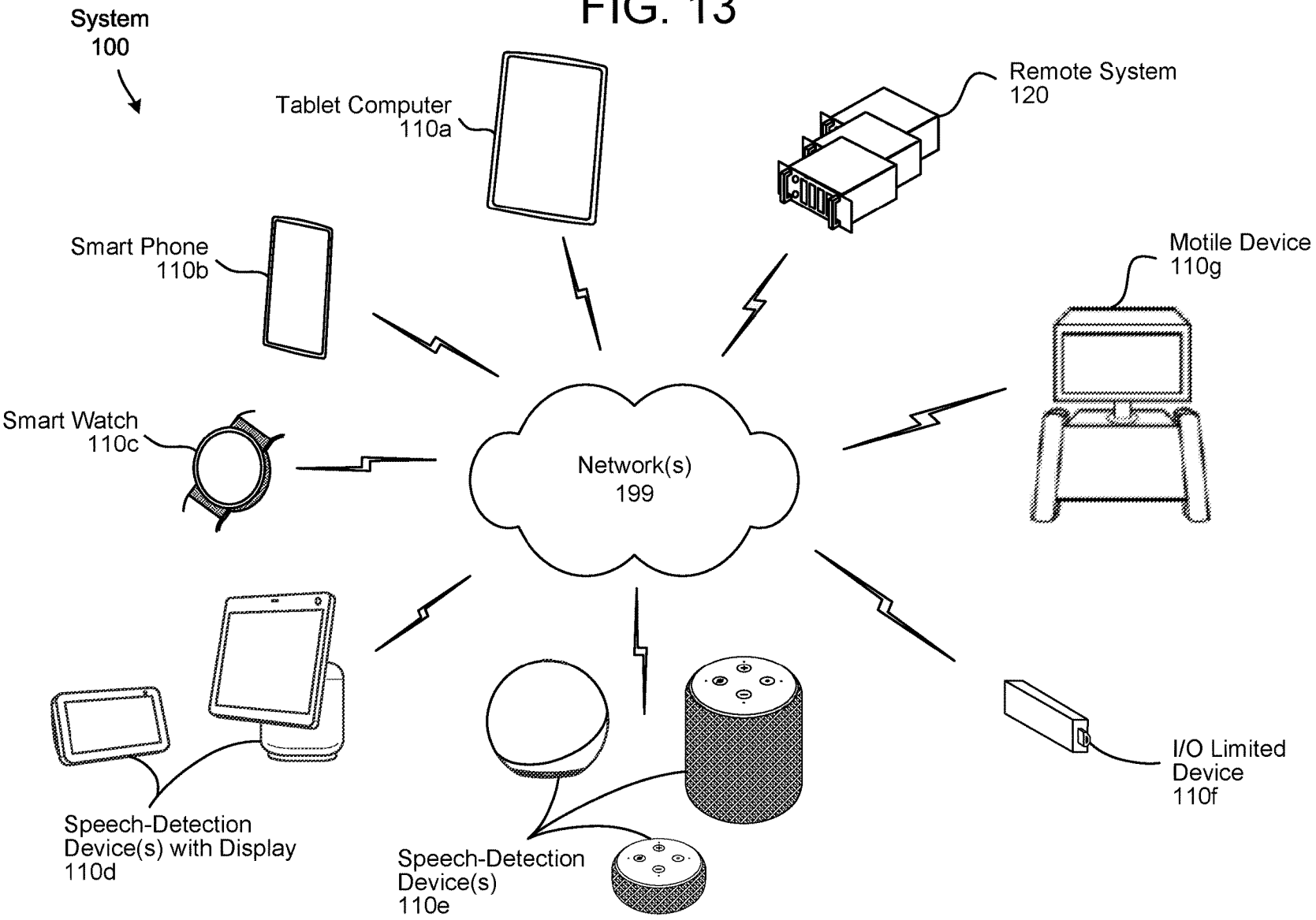
FIG. 13 illustrates an example of a computer network for use with the overall system, according to embodiments of the present disclosure.

As illustrated in FIG. 13, multiple devices (110*a*-110*g* and 120) may contain components of the system and the devices may be connected over a network(s) 199. The network(s) 199 may include a local or private network or may include a wide network such as the Internet. Devices may be connected to the network(s) 199 through either wired or wireless connections. As illustrated in FIG. 13, a tablet computer 110*a*, a smart phone 110*b*, a smart watch 110*c*, speech-detection device(s) with a display 110*d*, speech-detection device(s) 110*e*, input/output (I/O) limited device 110*f*, and/or a motile device 110*g* (e.g., device capable of autonomous motion) may be connected to the network(s) 199 through a wired and/or wireless connection. For example, the devices 110 may be connected to the network(s) 199 via an Ethernet port, through a wireless service provider (e.g., using a WiFi or cellular network connection), over a wireless local area network (WLAN) (e.g., using WiFi or the like), over a wired connection such as a local area network (LAN), and/or the like.

Other devices are included as network-connected support devices, such as the remote system 120 and/or other devices (not illustrated). The support devices may connect to the network(s) 199 through a wired connection or wireless connection. The devices 110 may capture audio using one-or-more built-in or connected microphones or other audio capture devices, with processing performed by ASR components, NLU components, or other components of the same device or another device connected via the network(s) 199, such as an ASR component, NLU component, etc. of the remote system 120.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware, such as an Audio Front End (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising:

receiving, from a first microphone of a device, first audio data corresponding to a first time period;

receiving, from a second microphone of the device, second audio data corresponding to the first time period;

processing the first audio data and the second audio data using an adaptive filter to determine a first coefficient value corresponding to the first time period;

determining a delay time period corresponding to use of the first coefficient value;

receiving, from the first microphone, third audio data corresponding to a second time period, the second time period being the delay time period after the first time period;

receiving, from the second microphone, fourth audio data corresponding to the second time period; and processing the third audio data, the fourth audio data, and the first coefficient value to determine cancelled data.

2. The computer-implemented method of claim 1, wherein determination of the cancelled data comprises:

applying the first coefficient value to the fourth audio data to determine modified audio data; and subtracting the modified audio data from the third audio data to determine the cancelled data.

3. The computer-implemented method of claim 1, further comprising:

processing the cancelled data using a wakeword detection component to determine a representation of a wakeword; and in response to determining the representation of the wakeword, performing speech processing based at least in part on the cancelled data.

4. The computer-implemented method of claim 1, further comprising:

determining the cancelled data represents speech; and in response to determining the cancelled data represents speech, continue using the first coefficient value for further audio data corresponding to a third time period after the second time period.

5. The computer-implemented method of claim 4, further comprising:

determining the speech has ended; and in response to determining the speech has ended, using a second coefficient value for echo cancellation, the second coefficient value corresponding to a fourth time period after the second time period.

6. The computer-implemented method of claim 1, wherein processing the third audio data, the fourth audio data, and the first coefficient value to determine the cancelled data corresponds to a first mode of operation and wherein the method further comprises:

determining a loudspeaker in an environment of the device is emitting audio; and in response to the loudspeaker emitting audio, entering the first mode of operation.

7. The computer-implemented method of claim 1, wherein:

the third audio data includes a first representation of noise detected in an environment of the device;

the fourth audio data includes a second representation of the noise; and determination of the cancelled data results in at least partial cancellation of the noise as represented in the cancelled data.

8. The computer-implemented method of claim 1, further comprising:

emitting audio by a loudspeaker;

receiving, from at least one microphone of the device, fifth audio data including a representation of the audio;

processing the fifth audio data to determine acoustic characteristic data corresponding to an environment of the device; and processing the acoustic characteristic data to determine the delay time period.

9. The computer-implemented method of claim 1, further comprising:

receiving fifth audio data from a third microphone of the device;

processing at least the fourth audio data and the fifth audio data to determine a first matrix represent audio captured by the second microphone and the third microphone; and determining a second matrix including at least the first coefficient value, wherein determination of the cancelled data comprises processing the first matrix with respect to the second matrix to determine the cancelled data.

10. The computer-implemented method of claim 1, further comprising:

determining the cancelled data represents an acoustic event; and in response to determining the cancelled data represents the acoustic event, continue using the first coefficient value for further audio data corresponding to a third time period after the second time period.

11. A system comprising:

a first microphone of a device;

a second microphone of the device;

at least one processor; and at least one memory including instructions operable to be executed by the at least one processor to cause the system to:

receive, from the first microphone, a first audio data corresponding to a first time period;

receive, from the second microphone, a second audio data corresponding to the first time period;

process the first audio data and the second audio data using an adaptive filter to determine a first coefficient value corresponding to the first time period;

determine a delay time period corresponding to use of the first coefficient value;

receive, from the first microphone, a third audio data corresponding to a second time period, the second time period corresponding to the delay time period after the first time period;

receive, from the second microphone, a fourth audio data corresponding to the second time period; and process the third audio data, the fourth audio data, and the first coefficient value to determine cancelled data.

12. The system of claim 11, wherein the instructions that cause the system to determine the cancelled data comprise instructions that, when executed by the at least one processor, cause the system to:

apply the first coefficient value to the fourth audio data to determine modified audio data; and subtract the modified audio data from the third audio data to determine the cancelled data.

13. The system of claim 11, wherein the memory further comprises instructions that, when executed by the at least one processor, further cause the system to:

process the cancelled data using a wakeword detection component to determine a representation of a wakeword; and in response to determination that the representation of the wakeword, perform speech processing based at least in part on the cancelled data.

14. The system of claim 11, wherein the memory further comprises instructions that, when executed by the at least one processor, further cause the system to:

determine the cancelled data represents speech; and in response to determination that the cancelled data represents speech, continue use of the first coefficient value for further audio data corresponding to a third time period after the second time period.

15. The system of claim 14, wherein the memory further comprises instructions that, when executed by the at least one processor, further cause the system to:

determine the speech has ended; and in response to determination that the speech has ended, use a second coefficient value for echo cancellation, the second coefficient value corresponding to a fourth time period after the second time period.

16. The system of claim 11, wherein processing of the third audio data, the fourth audio data, and the first coefficient value to determine the cancelled data corresponds to a first mode of operation and wherein the memory further comprises instructions that, when executed by the at least one processor, further cause the system to:

determine a loudspeaker in an environment of the device is emitting audio; and in response to the loudspeaker emitting audio, enter the first mode of operation.

17. The system of claim 11, wherein:

the third audio data includes a first representation of noise detected in an environment of the device;

the fourth audio data includes a second representation of the noise; and determination of the cancelled data results in at least partial cancellation of the noise as represented in the cancelled data.

18. The system of claim 11, wherein the memory further comprises instructions that, when executed by the at least one processor, further cause the system to:

emit audio by a loudspeaker;

receive, from at least one microphone of the device, a fifth audio data including a representation of the audio;

process the fifth audio data to determine acoustic characteristic data corresponding to an environment of the device; and process the acoustic characteristic data to determine the delay time period.

19. The system of claim 11, wherein the memory further comprises instructions that, when executed by the at least one processor, further cause the system to:

receive fifth audio data from a third microphone of the device;

process at least the fourth audio data and the fifth audio data to determine a first matrix represent audio captured by the second microphone and the third microphone; and determine a second matrix including at least the first coefficient value, wherein determination of the cancelled data comprises processing the first matrix with respect to the second matrix to determine the cancelled data.

20. The system of claim 11, wherein the memory further comprises instructions that, when executed by the at least one processor, further cause the system to:

determine the cancelled data represents an acoustic event; and in response to determination that the cancelled data represents the acoustic event, continue use of the first coefficient value for further audio data corresponding to a third time period after the second time period.

* * * * *